US006160234A

United States Patent [19]

Wehrli, III et al.

[11] Patent Number: 6,160,234

[45] Date of Patent: Dec. 12, 2000

[54] REDUCED DRAG RATCHET

[75] Inventors: Henry Anthony Wehrli, III, Monroeville; Brian Matthew Loehlein, Pittsburgh, both of Pa.

[73] Assignee: Eaton Corporation, Cleveland, Ohio

[21] Appl. No.: 09/302,108

[22] Filed: Apr. 29, 1999

[51] Int. Cl.[7] ..... H01H 5/00

[52] U.S. Cl. ..... 200/400

[58] Field of Search ..... 74/148, 149; 200/17 R, 200/400, 401, 500, 501, 331; 218/154; 335/16, 140, 171

[56] References Cited

U.S. PATENT DOCUMENTS

| | | | |
|---|---|---|---|
| 3,689,721 | 9/1972 | McGuffie | 200/153 SC |
| 3,773,995 | 11/1973 | Davies | 200/153 SC |
| 4,167,988 | 9/1979 | Acampora et al. | 185/40 R |
| 5,280,258 | 1/1994 | Opperthauser | 335/162 |
| 5,595,287 | 1/1997 | Niklaus | 200/501 |
| 5,651,451 | 7/1997 | Castonguay et al. | 200/400 |
| 5,723,836 | 3/1998 | Okuno et al. | 200/501 |
| 5,901,838 | 5/1999 | Nakatani et al. | 200/400 |
| 5,938,008 | 8/1999 | Wehrli et al. | 200/400 |

*Primary Examiner*—Micheal Friedhofer
*Attorney, Agent, or Firm*—Martin J. Moran

[57] ABSTRACT

The large close spring in the operating mechanism of electrical switching apparatus is charged by a charging mechanism which includes a charging cam mounted on a cam shaft and rotated by a ratchet wheel. A stop member is employed for engagement with the ratchet wheel to prevent reverse rotation of the ratchet wheel during charging of the close spring. To reduce friction force between the stop member and the ratchet wheel once the close spring is fully charged and it is desired to discharge the spring, the ratchet wheel includes a toothless region formed on the periphery thereof. The ratchet wheel is positioned such that the stop member is in engagement with the toothless region once the close spring is fully charged. Friction between the stop member and the ratchet wheel is reduced by eliminating the need for the stop member to traverse the teeth of the ratchet wheel as discharging of the spring is initiated.

17 Claims, 15 Drawing Sheets

REDUCED DRAG RATCHET

BACKGROUND OF THE INVENTION

1. Field of the Invention

This invention relates to electrical switching apparatus especially such as power circuit breakers, network protectors and switches used in low voltage electric power circuits carrying large currents. More particularly, it relates to such apparatus having a manually or electrically operated ratchet mechanism which charges the large spring used to close the switching apparatus.

2. Background Information

Electrical switching apparatus for opening and closing electric power distribution circuits typically utilize an energy storage device in the form of one or more large springs to close the contacts of the device into the large currents which can be drawn in such circuits. Such electrical switching apparatus includes power circuit breakers and network protectors which provide protection, and electrical switches which are used to energize and deenergize parts of the circuit or to transfer between alternative power sources. These devices also include an open spring or springs which rapidly separate the contacts to interrupt current flowing in the power circuit. These open springs are charged during closing by the close spring which, therefore, must store sufficient energy to both overcome the mechanical and magnetic forces for closing as well as charging the open springs. As indicated, either or both of the close spring and open spring can be a single spring or multiple springs and should be considered as either even though the singular is hereafter used for convenience.

An operating mechanism mounts and controls the charging and discharge of the close spring. One type of such operating mechanism includes a cam member which rotates in a single direction and is coupled to the close spring to charge the spring as the cam is rotated either manually, by handle, or automatically, by a motor, through a ratchet mechanism. As the close spring becomes fully charged, the cam goes overcenter and the stored energy in the spring tends to drive the cam. A close prop holds the spring in the charged state.

Typically, a stop member is provided for engaging ratchet teeth of the ratchet mechanism to prevent reverse rotation of the ratchet mechanism during charging and until the cam goes overcenter and is held by the close prop when the close prop is in an unlatched position (where the close prop is disengaged from the cam member so that the cam member is free to be rotated by the close spring). The stop member is also typically in engagement with the ratchet teeth of the ratchet mechanism when the close prop is in a latch position (where the close prop engages the cam member and prevents rotation of the cam member). The engagement between the stop member and the ratchet teeth of the ratchet mechanism, both when the close prop is in the unlatched and latched position, results in friction or a drag force between the stop member and the ratchet mechanism. This drag force increases the release force required for the close prop, particularly when larger close springs are used to increase the current rating. There is room, therefore, for improvement in such electrical switching apparatus and particularly in the manner in which the stop member cooperates with the ratchet mechanism.

There is a need for improved electrical switching apparatus having a stop member for cooperating with a ratchet mechanism that minimizes friction or drag force therebetween during initiation of a closing operation of the electrical switching apparatus.

There is also a need for an improved charging mechanism for electrical switching apparatus that minimizes friction or drag force in the charging mechanism during initiation of a closing operation of the electrical switching apparatus.

SUMMARY OF THE INVENTION

These and other needs are satisfied by the invention which is directed to electrical switching apparatus for an electric power distribution circuit which generally includes separable contacts for opening and closing the electric power distribution circuit, an operating mechanism for operating the separable contacts and a charging mechanism.

The operating mechanism includes a close spring, a cam shaft, a first cam member mounted on the cam shaft along with coupling means for coupling the first cam member to the close spring for charging the close spring, and a second cam member mounted on the cam shaft where the second cam member is coupled to and driven by the close spring as the close spring becomes fully charged. The operating mechanism also includes a pivotally mounted close prop having a latch position in which it engages the second cam member and prevents rotation of the first cam member and the second cam member, and an unlatched position in which it is disengaged from the second cam member so that the first cam member and the second cam member are free to be rotated by the close spring.

The charging mechanism includes a ratchet wheel coupled to the cam shaft. The ratchet wheel includes ratchet teeth extending from a periphery thereof and a toothless region formed on the periphery. The charging mechanism further includes drive means for rotating the ratchet wheel and a pivotally mounted stop member (commonly referred to in the art as a "stop dog") along with biasing means for biasing the stop member into successive engagement with the ratchet teeth to prevent reverse rotation of the ratchet wheel when the close prop is in the unlatched position. The biasing means also biases the stop member into engagement with the toothless region of the ratchet wheel when the close prop is in the latch position.

The toothless region on the periphery of the ratchet wheel allows for the stop member to be in engagement therewith so as to minimize the friction or the drag force between the ratchet wheel and the stop member during the transition from the close spring being fully charged to discharging of the close spring to initiate a closing operation for the electrical switching apparatus.

The invention is also directed to a charging mechanism for electrical switching apparatus having an operating mechanism where the charging mechanism includes a ratchet wheel coupled to the operating mechanism and having ratchet teeth extending from a periphery thereof. The ratchet wheel includes a toothless region on the periphery thereof. The charging mechanism also includes a drive link mounted for engagement with and rotation of the ratchet wheel. The charging mechanism further includes a pivotally mounted stop dog and biasing means for biasing the stop dog into successive engagement with the ratchet teeth to prevent reverse rotation of the ratchet wheel when a force is applied to the ratchet wheel by the operating mechanism. The biasing means also biases the stop dog into engagement with the toothless region of the ratchet wheel when the force is removed from the ratchet wheel. The engagement between the stop dog and the toothless region of the ratchet wheel minimizes drag force or friction between these components during a closing operation of the electrical switching apparatus.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

The invention will be described as applied to a power air circuit breaker; however, it also has application to other electrical switching apparatus for opening and closing electric power circuits. For instance, it has application to switches providing a disconnect for branch power circuits and transfer switches used to select alternate power sources for a distribution system. The major difference between a power circuit breaker and these various switches is that the circuit breaker has a trip mechanism which provides overcurrent protection. The invention could also be applied to network protectors which provide protection and isolation for distribution circuits in a specified area.

Figure 1:
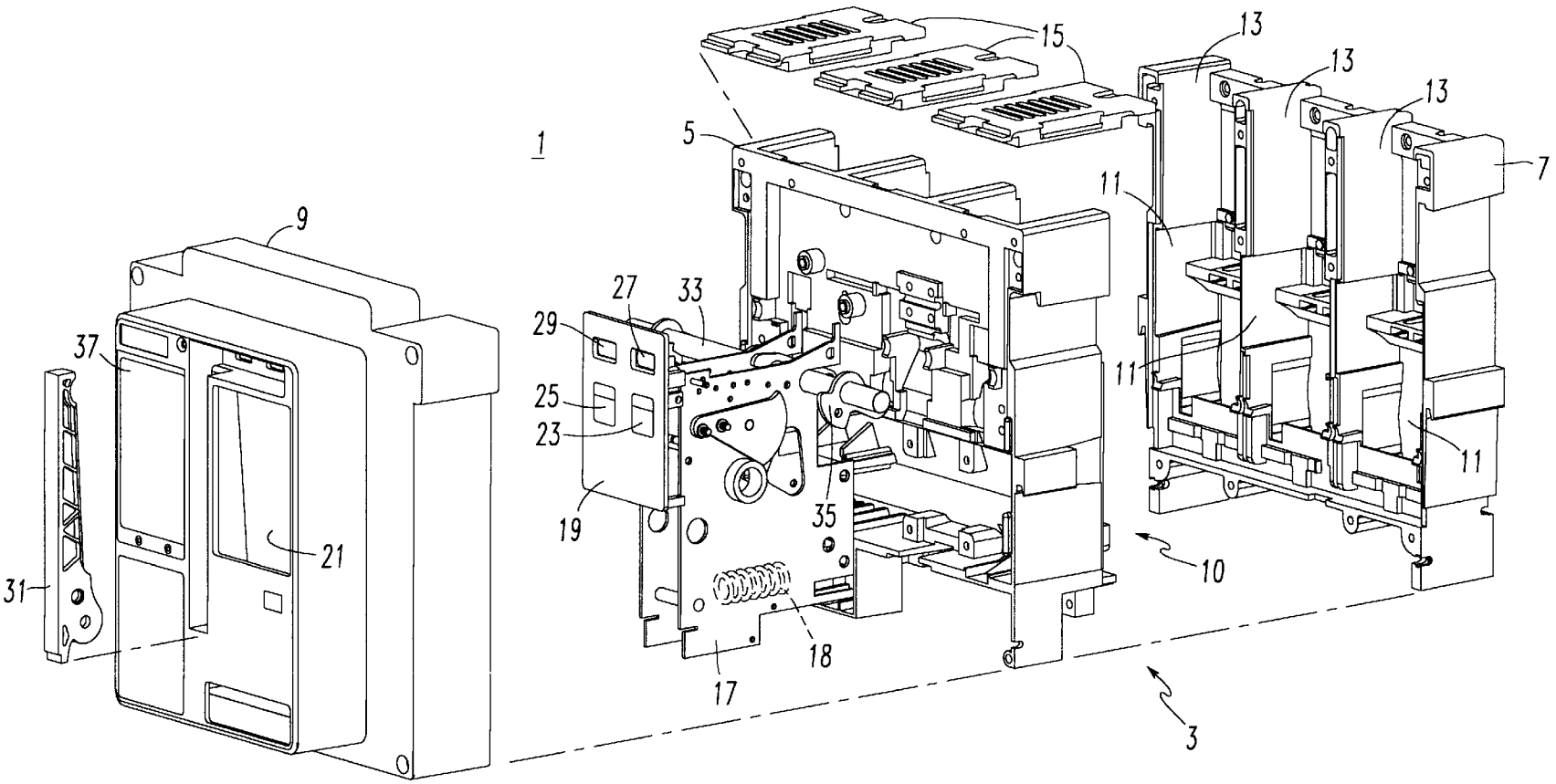
FIG. 1 is an exploded isometric view of a low voltage, high current power circuit breaker in accordance with the invention.

Referring to FIG. 1, the power air circuit breaker 1 of the invention has a housing 3 which includes a molded front casing 5 and a rear casing 7, and a cover 9. The exemplary circuit breaker 1 has three poles 10 with the front and rear casings 5, 7 forming three, pole chambers 11. Each pole 10 has an arc chamber 13 which is enclosed by a ventilated arc chamber cover 15.

Circuit breaker 1 has an operating mechanism 17 which is mounted on the front of the front casing 5 and is enclosed by the cover 9. The operating mechanism 17 has a face plate 19 which is accessible through an opening 21 in the cover. The operating mechanism 17 includes a large spring 18 which is charged to store energy for closing the circuit breaker. Face plate 19 mounts a push to close button 23 which is actuated to discharge the close spring for closing the circuit breaker, and a push to open button 25 for opening the circuit breaker. Indicators 27 and 29 display the condition of the close spring and the open/closed state of the contacts, respectively. The close spring 18 is charged by operation of the charging handle 31 or remotely by a motor operator (not shown).

The common operating mechanism 17 is connected to the individual poles by a pole shaft 33 with a lobe 35 for each pole. As is conventional, the circuit breaker 1 includes an electronic trip unit 37 supported in the cover 9 which actuates the operating mechanism 17 to open all of the poles 10 of the circuit breaker through rotation of the pole shaft 33 in response to predetermined characteristics of the current flowing through the circuit breaker.

Figure 2:
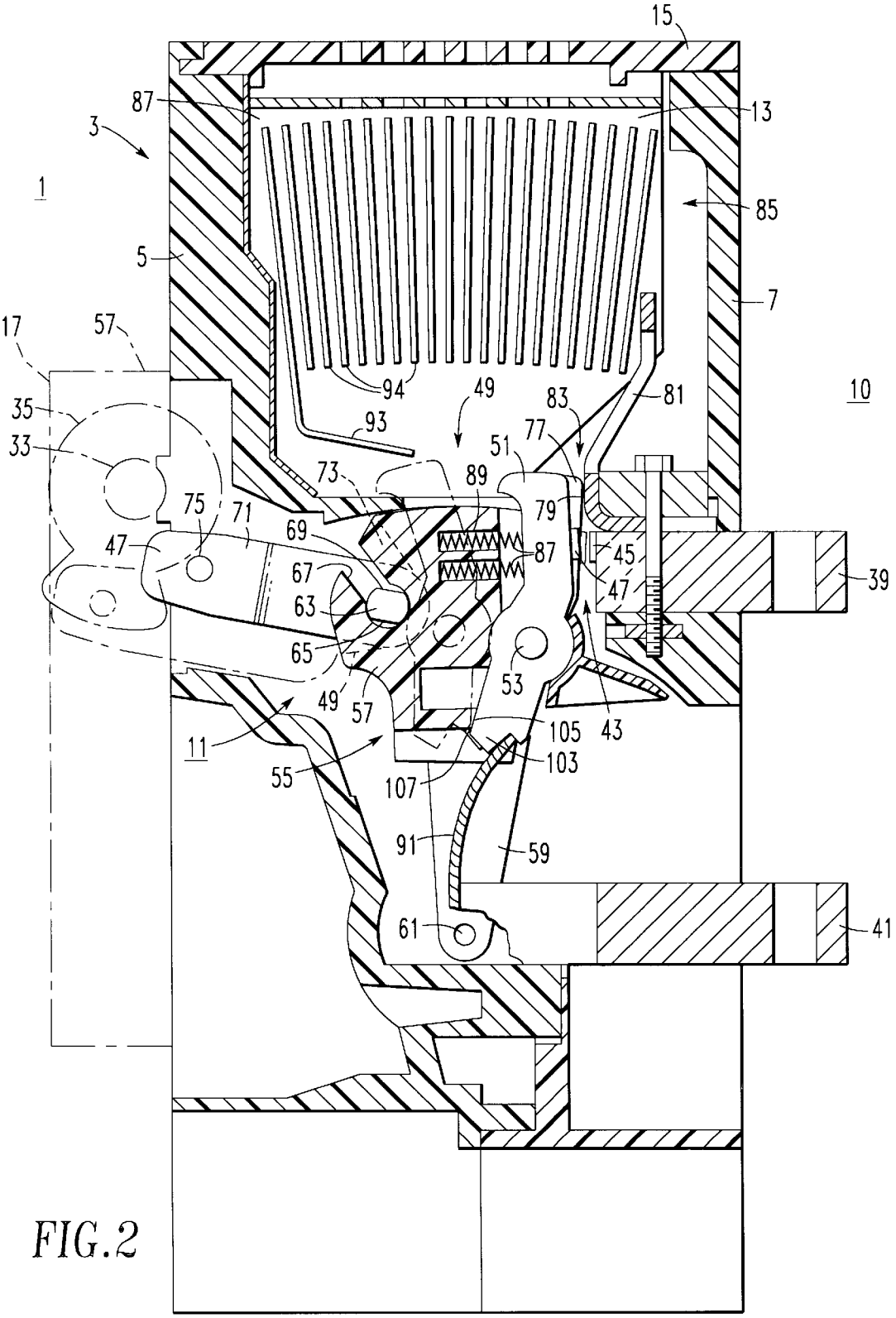
FIG. 2 is a vertical section through a pole of the circuit breaker of FIG. 1 shown as the contacts separate during opening.
Figure 3:
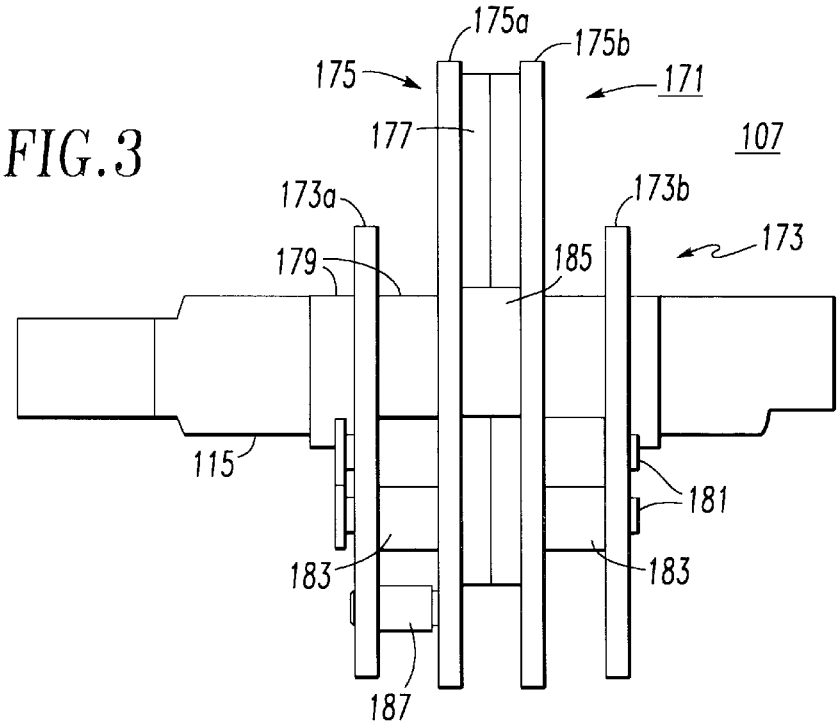
FIG. 3 is a side elevation view of the cam assembly which forms part of the operating mechanism.
Figure 12:
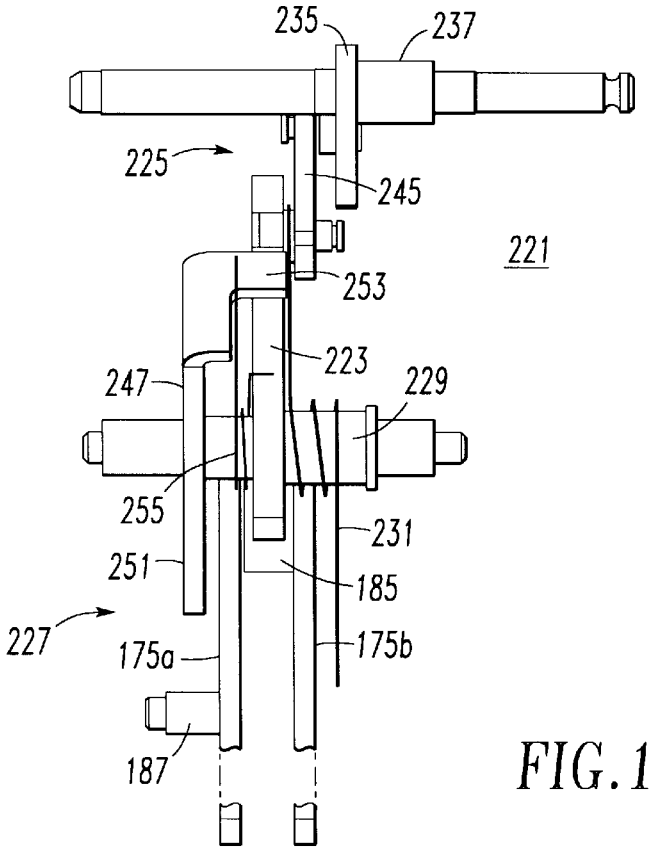
FIG. 12 is an end view of the close prop assembly.

FIG. 2 is a vertical section through one of the pole chambers. The pole 10 includes a line side conductor 39 which projects out of the rear casing 7 for connection to a source of ac electric power (not shown). A load conductor 41 also projects out of the rear casing 7 for connection typically to the conductors of the load network (also not shown).

Each pole 10 also includes a pair of main contacts 43 that include a stationary main contact 45 and a moveable main contact 47. The moveable main contact 47 is carried by a moving conductor assembly 49. This moving conductor assembly 49 includes a plurality of contact fingers 51 which are mounted in spaced axial relation on a pivot pin 53 secured in a contact carrier 55. The contact carrier 55 has a molded body 57 and a pair of legs 59 (only one shown) having pivots 61 rotatably supported in the housing 3.

The contact carrier 55 is rotated about the pivots 61 by the drive mechanism 17 which includes a drive pin 63 received in a transverse passage 65 in the carrier body 57 through a slot 67 to which the drive pin 63 is keyed by flats 69. The drive pin 63 is fixed on a drive link 71 which is received in a groove 73 in the carrier body. The other end of the drive link is pivotally connected by a pin 75 to the associated pole arm 35 on the pole shaft 33 similarly connected to the carriers (not shown) in the other poles of the circuit breaker. The pole shaft 33 is rotated by the operating mechanism 17 in a manner to be described.

A moving main contact 47 is fixed to each of the contact fingers 51 at a point spaced from the free end of the finger. The portion of the contact finger adjacent the free end forms a moving arcing contact or "arc toe" 77. A stationary arcing contact 79 is provided on the confronting face of an integral arcing contact and runner 81 mounted on the line side conductor 39. The stationary arcing contact 79 and arc toe 77 together form a pair of arcing contacts 83. The integral arcing contact and runner 81 extends upward toward a conventional arc chute 85 mounted in the arc chamber 13.

The contact fingers 51 are biased clockwise as seen in FIG. 2 on the pivot pin 53 of the carrier 55 by pairs of helical compression springs 87 seated in recesses 89 in the carrier body 55. The operating mechanism 17 rotates the pole shaft 33 which in turn pivots the contact carrier 55 clockwise to a closed position (not shown) to close the main contacts 43. To open the contacts, the operating mechanism 17 releases the pole shaft 33 and the compressed springs 87 accelerate the carrier 55 in a counterclockwise direction to an open position (not shown). As the carrier is rotated clockwise toward the closed position, the arc toes 77 contact the stationary arcing contacts 79 first. As the carrier continues to move clockwise, the springs 87 compress as the contact fingers 51 rock about the pivot pin 53 until the main contacts 43 close. Further clockwise rotation to the fully closed position (not shown) results in opening of the arcing contacts 83 while the main contacts 43 remain closed. In that closed position, a circuit is completed from the line conductor 39 through the closed main contacts 43, the contact fingers 51, flexible shunts 91, and the load conductor 41.

To open the circuit breaker 1, the operating mechanism 17 releases the pole shaft 33 so that the compressed springs 87 accelerate the carrier 55 counterclockwise as viewed in FIG. 2. Initially, as the carrier 55 moves away from the line conductor 39, the contact fingers 51 rock so that the arcing contacts 83 close while the main contacts 43 remain closed. As the carrier 55 continues to move counterclockwise, the main contacts 43 open and all of the current is transferred to the arcing contacts 83 which is the condition shown in FIG. 2. If there is a sizeable current being carried by the circuit breaker such as when the circuit breaker trips open in response to an overcurrent or short circuit, an arc is struck between the stationary arcing contacts 79 and the moveable arcing contacts or arc toes 77 as these contacts separate with continued counterclockwise rotation of the carrier 55. As the main contacts 43 have already separated, the arcing is confined to the arcing contacts 83 which preserves the life of the main contacts 43. The electromagnetic forces produced by the current sustained in the arc push the arc outward toward the arc chute 85 so that the end of the arc at the stationary arc contact 79 moves up the integral arcing contact and runner 81 and into the arc chute 85. At the same time, the rapid opening of the carrier 55 brings the arc toes 77 adjacent the free end of the arc top plate 93 as shown in phantom in FIG. 2 so that the arc extends from the arc toes 77 to the arc top plate 93 and moves up the arc top plate into the arc plates 94 which break the arc up into shorter sections which are then extinguished.

The close spring 18 is a common, round wire, heavy duty, helical compression spring closed and ground flat on both ends. A compression spring is used because of its higher energy density than a tension spring.

Referring to FIGS. 3–7, cam assembly 107 includes cam shaft 115 and a cam member 171. The cam member 171 includes a charge cam 173 formed by a pair of charge cam plates 173*a*, 173*b* mounted on the cam shaft 115. The charge cam plates 173*a*, 173*b* straddle a drive cam 175 which is formed by a second pair of cam plates 175*a*, 175*b*. A cam spacer 177 sets the spacing between the drive cam plates 175*a*, 175*b* while spacer bushings 179 separate the charge cam plates 173*a*, 173*b* from the drive cam plates. The cam plates 173, 175 are all secured together by rivets 181 extending through rivet spacers 183 between the plates. A stop roller 185 is pivotally mounted between the drive cam plates 175*a* and 175*b* and a reset pin 187 extends between the drive cam plate 175*a* and the charge cam plate 173*a*. The cam assembly 107 is a 360° mechanism which compresses the spring 18 to store energy during part of the rotation, and which is rotated by release of the energy stored in the spring 18 during the remainder of rotation. This is accomplished through engagement of the charge cam plates 173*a*, 173*b* by the rocker rollers 165. The preload on the spring 18 maintains the rocker rollers 165 in engagement with the charge cam plates 173*a*, 173*b*. The charge cam 173 has a cam profile 189 with a charging portion 189*a* which at the point of engagement with the rocker rollers 165 increases in diameter with clockwise rotation of the cam member 171. The cam shaft 115 and therefore the cam member 171 is rotated either manually by the handle 31 or by an electric motor 421 (see FIG. 13) in a manner to be described. The charging portion 189*a* of the charge cam profile 189 is configured so that a substantially constant torque is required to compress the spring 18. This provides a better feel for manual charging and reduces the size of the motor required for automatic charging as the constant torque is below the peak torque which would normally be required as the spring approaches the fully compressed condition.

The cam profile 189 on the charge cam 173 also includes a closing portion 189*b* which decreases in diameter as the charge cam 173 rotates against the rocker rollers 165 so that the energy stored in the spring 18 drives the cam member 171 clockwise when the mechanism is released in a manner to be discussed.

The drive cam 175 of the cam member 171 has a cam profile 191 which in certain rotational positions is engaged by a drive roller 193 mounted on a main link 195 of the main link assembly 111 by a roller pin 197. The other end of the main link 195 is pivotally connected to a drive arm 199 on the pole shaft 33 by a pin 201. This main link assembly 111 is coupled to the drive cam 175 for closing the circuit breaker 1 by a trip mechanism 203 which includes a hatchet plate 205 pivotally mounted on a hatchet pin 207 supported by the side plates 97 and biased counterclockwise by a spring 219. A banana link 209 is pivotally connected at one end to an extension on the roller pin 197 of the main link assembly and at the other end is pivotally connected to one end of the hatchet plate 205. The other end of the hatchet plate 205 has a latch ledge 211 which engages a trip D shaft 213 when the shaft is rotated to a latch position. With the hatchet plate 205 latched, the banana link 209 holds the drive roller 193 in engagement with the drive cam 175. In operation, when the trip D shaft 213 is rotated to a trip position, the latch ledge 211 slides off of the trip D shaft 213 and the hatchet plate 205 passes through a notch 215 in the trip D shaft which repositions the pivot point of the banana link 209 connected to the hatchet plate 205 and allows the drive roller 193 to float independently of the drive cam 175.

Figure 4:
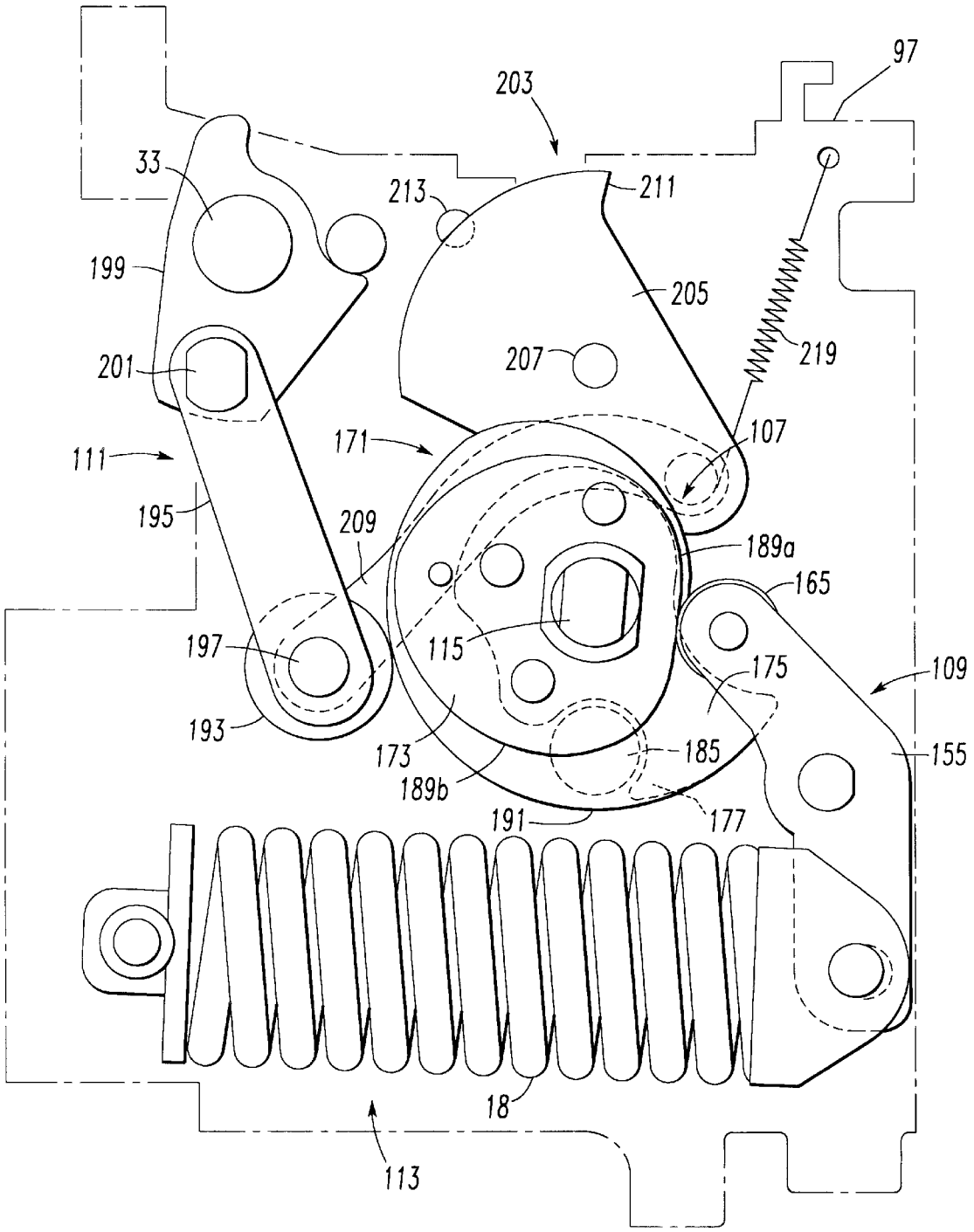
FIG. 4 is an elevation view illustrating the relationship of the major components of the operating mechanism shown with the contacts open and the close spring discharged.

The sequence of charging and discharging the close spring 18 can be understood by reference to FIGS. 4–7. In FIG. 4 the mechanism is shown in the discharged open position, that is, the close spring 18 is discharged and the contacts 43 are open. It can be seen that the cam member 171 is positioned so that the charge cam 173 has its smallest radius in contact with the rocker rollers 165. Thus, the rocker 155 is rotated to a full counterclockwise position and the spring 18 is at its maximum extension. It can also be seen that the trip mechanism 203 is not latched so that the drive roller 193 is floating although resting against the drive cam 175. As the cam shaft 115 is rotated clockwise manually by the handle 31 or through operation of the charge motor 421 the charge portion 189*a* of the charge profile on the charge cam which progressively increases in diameter, engages the rocker roller 165 and rotates the rocker 155 clockwise to compress the spring 18. As mentioned, the configuration of this charge portion 189*a* of the profile is selected so that a constant torque is required to compress the spring 18. During this charging of the spring 18, the driver roller 193 is in contact with a portion of the drive cam profile 191 which has a constant radius so that the drive roller 193 continues to float.

Figure 5:
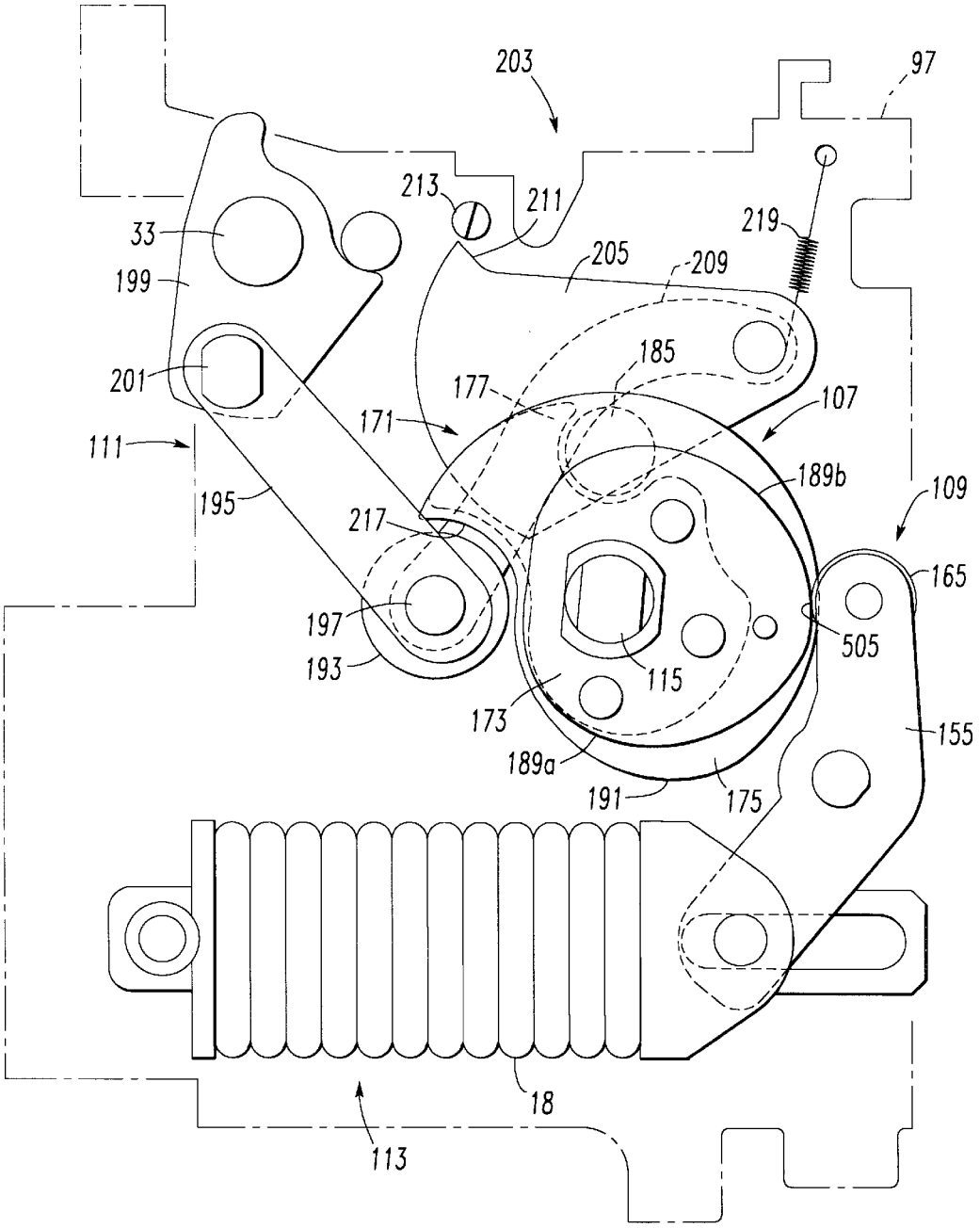
FIG. 5 is a view similar to FIG. 4 shown with the contacts open and the close spring charged.
Figure 6:
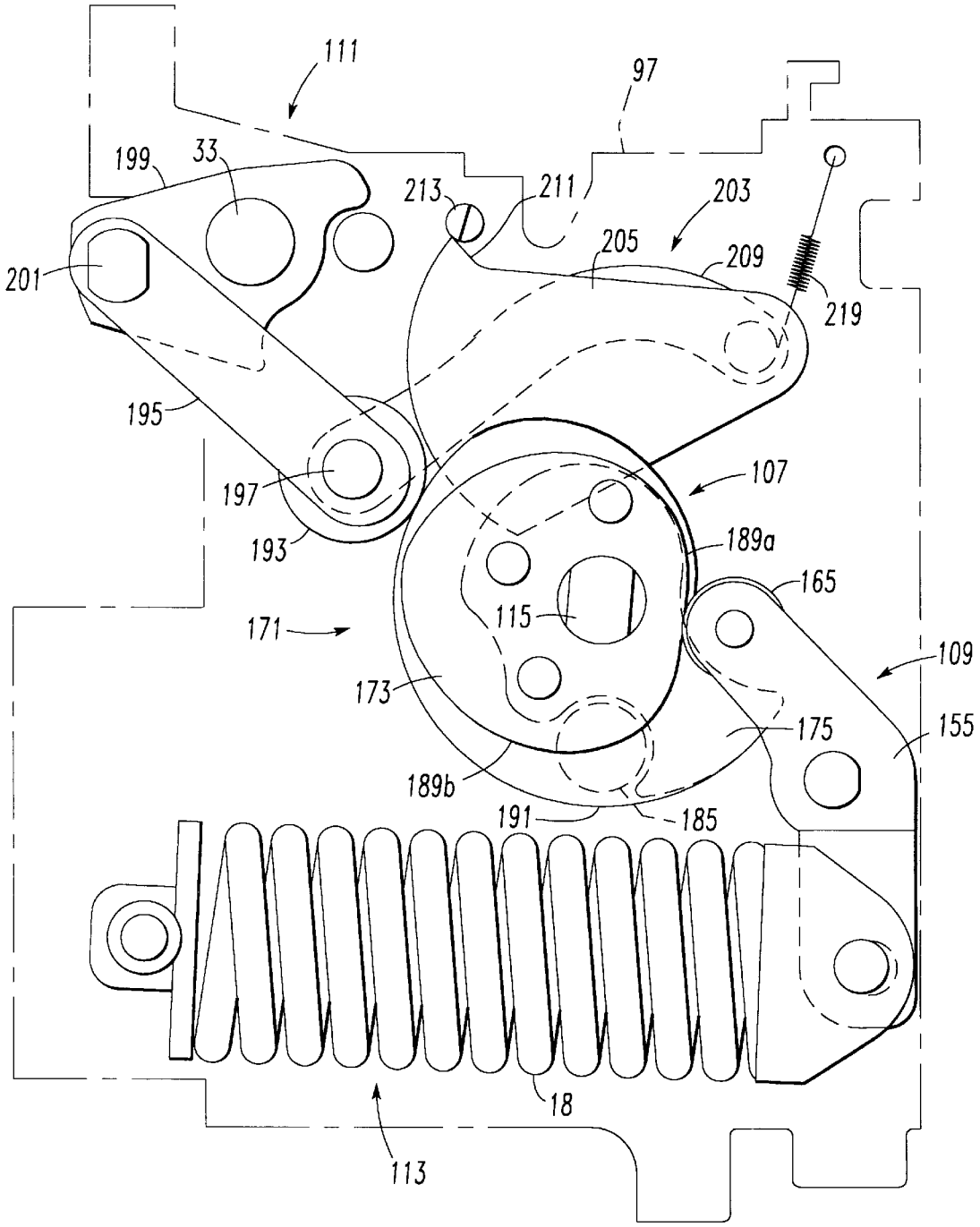
FIG. 6 is a view similar to FIG. 4 shown with the contacts closed and the close spring discharged.

Moving now to FIG. 5, as the spring 18 becomes fully charged, the drive roller 193 falls off of the drive cam profile 191 into a recess 217. This permits the reset spring 219 to rotate the hatchet plate 205 counterclockwise until the latch ledge 211 passes slightly beyond the trip D shaft 213. This raises the pivot point of the banana link 209 on the hatchet plate 205 so that the drive roller 193 is raised to a position where it rests beneath the notch 217 in the drive cam 175. At the same time, the rocker rollers 165 reach a point just after 170° rotation of the cam member where they enter the close portion 189*b* of the charge cam profile 189. On this portion 189*b* of the charge cam profile, the radius of the charge cam 173 in contact with the rocker rollers 165 decreases in radius with clockwise rotation of the cam member 171. Thus, the close spring 18 applies a force tending to continue rotation of the cam member 171 in the clockwise direction. However, a close prop (not shown in FIG. 5) which is part of a close prop mechanism to be described later, engages the stop roller 185 and prevents further rotation of the cam member 171. Thus, the spring 18 remains fully charged ready to close the contacts 43 of the circuit breaker 1.

The contacts 43 of the circuit breaker 1 are closed by release of the close prop in a manner to be described. With the close prop disengaged from the stop roller 185, the spring energy is released to rapidly rotate the cam member 171 to the position shown in FIG. 10. As the cam member 171 rotates, the drive roller 193 is engaged by the cam profile 191 of the drive cam 175. The radius of this cam profile 191 increases with cam shaft rotation and since the banana link 209 holds the drive roller 193 in contact with this surface, the pole shaft 33 is rotated to close the contacts 43 as described in connection with FIG. 2. At this point the latch ledge 211 engages the D latch 213 and the contacts are latched closed. If the circuit breaker is tripped at this point by rotation of the trip D shaft 213 so that this latch ledge 211 is disengaged from the D shaft 213, the very large force generated by the compressed contact springs 87 (see FIG. 2) exerted through the main link 195 pulls the pivot point of the banana link 209 on the hatchet plate 205 clockwise downward and the drive roller 193 drops free of the drive cam 175 allowing the pole shaft 33 to rotate and the contacts 43 to open. With the contacts 43 open and the spring 18 discharged the mechanism would again be in the state shown in FIG. 4.

Figure 7:
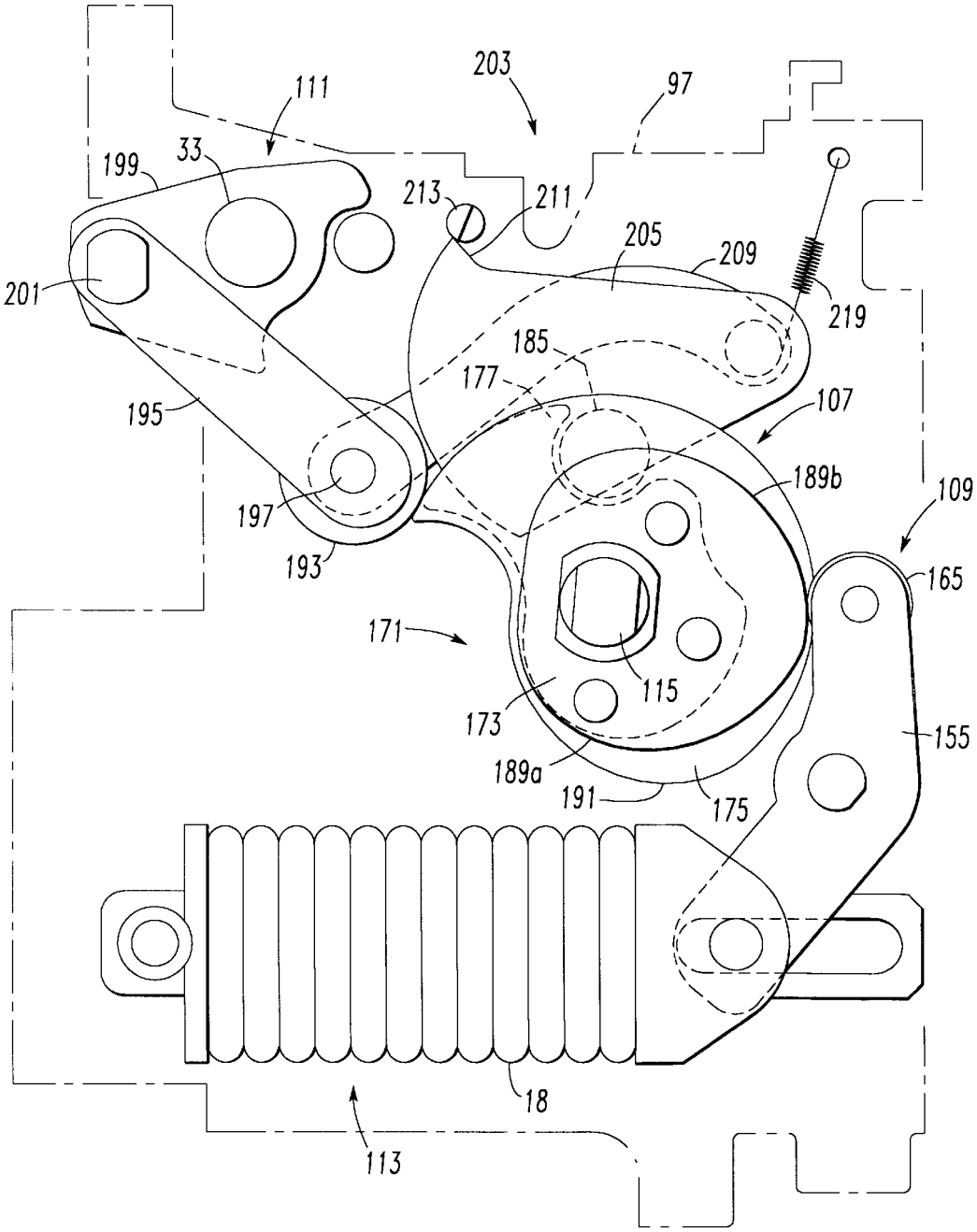
FIG. 7 is a view similar to FIG. 4 shown with the contacts closed and the close spring charged.

Typically, when the circuit breaker is closed, the close spring 18 is recharged, again by rotation of the cam shaft 115 either manually or electrically. This causes the cam member 171 to return to the same position as in FIG. 5, but with the trip mechanism 203 latched, the banana link 209 keeps the drive roller 193 engaged with the drive profile 191 on the drive cam 175 as shown in FIG. 7. If the circuit breaker is tripped at this point by rotation of the trip D latch 213 so that the hatchet plate 205 rotates clockwise, the drive roller 193 will drop down into the notch 217 in the drive cam 175 and the circuit breaker will open.

As mentioned, during the first 180° of rotation of the cam member 171, the spring 18 is being charged and during the second 180° of rotation the energy in the spring is being delivered to the contact structure at a controlled rate. In other words, during the latter phase, the spring 18, the cam member 171 and drive roller 193 are acting like a motor. As discussed, it is desirable to provide a constant charging torque both for the manual charge because it provides a better "feel" to the operator, and for the electric operator which can be sized for constant torque rather than peak torque. During the first 10° of charging, the torque is ramped up to the selected constant value. This provides a user friendly feel instead of letting a person hit a wall of constant torque. It also allows the charging motor, if used, to get up to speed before reaching maximum torque. During the last 10° of the charging cycle, the torque is reduced from a maximum positive torque to a slightly negative torque. This allows the cam assembly 107, and specifically the stop roller 185 and the close prop 223, to rest against each other for the closing half of the cycle. The profile 189 of the charge cam 173 is designed so that the force between the roller 185 and the prop 223 is a negative 5 to 15 pounds, depending upon the size of the compression spring 18. Once the close prop 223 is removed, the cam assembly 107 begins rotating the remaining 180° due to the force of the spring 18 and the slope of the charge cam closing profile 189*b*.

The close cam profile 189*b* between 180° and 360° is very critical for the optimum operation of the circuit breaker. In prior art mechanisms, without a drive cam 175, it is common to simply release the spring energy and let the contacts 43 slam closed. The spring 18 is usually sized to close the contacts 43 quickly and without contact bounce. These goals can be incompatible and compromises are made. However, with the close cam 173 of the invention it is possible to control the release of energy to the moving conductor assembly 49. This close cam profile 189*b* can be selected so that the contacts can be closed quickly, firmly, and with no contact bounce. It has been found that at least 50% of the energy stored in the spring 18 should be released prior to contact closure, and in fact prior to contact of the arcing contacts 83. Preferably, about 70% of the energy is released before the contacts begin to touch. A computer simulation can be used to optimize the cam profiles 189, 191. In most applications, the charging portion of the charge cam profile 189*a* should remain about the same. However, the closing portion of the charge cam profile 189*b* is unique for the moving conductor assembly 49 (mass and geometry) and for the type of contacts 43, 83 being used.

Because of the high energies and forces associated with the drive mechanism, hardened stainless steel close cams 173 and drive cams 175 are used. However, it should be noted that all forces are balanced about the center plane of the cam assembly 107 through use of the duel charge cams 173*a*, 173*b* straddling the symmetrical drive cam 175 to prevent warping and twisting. Symmetrical loading is believed important to make a durable mechanism.

Figure 8:
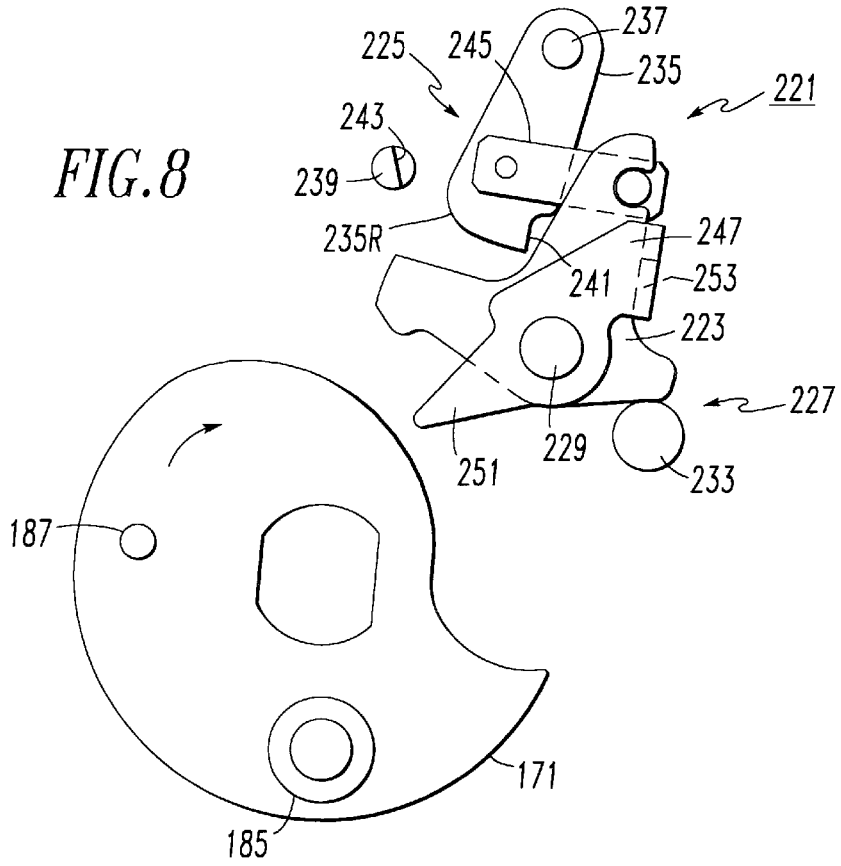
FIG. 8 is an elevation view of the close prop which controls release of the close spring shown in relation to the cam member of the operating mechanism with the close spring discharged and the close prop released.

The close prop mechanism 221 is illustrated in FIGS. 8–12. This mechanism includes the close prop 223, a latch assembly 225 and a reset device 227. As mentioned, the close prop 223 engages the stop roller 185 on the cam member 171 to hold the close spring 18 in the charged condition. The pivot pin 229 for the close prop 223 is positioned exactly in the line of force exerted by the stop roller 185 on the close prop 223 to minimize the unlatching force and to reduce the likelihood of shock out (the unintentional opening of the contacts due to vibration or shock). A large torsion spring 231 (see FIG. 12) biases the close prop 223 to the release position against a stop 233 as shown in FIG. 8. It is held in the latched position illustrated in FIG. 10 by the latch assembly 225. This latch assembly 225 includes a close latch plate 235 pivotally mounted on a latch plate support shaft 237 supported in the side plates 97, and a close D latch shaft 239 journaled in the side plates. The close latch plate 235 has a latch ledge 241 which engages the close D latch shaft 239 with the latter in the cocked position, but falls through a notch 243 in the close D latch shaft 239 when the shaft is rotated to a release position. The latch assembly 225 also includes a latch link 245 connecting the close prop 223 to the close latch plate 235. With the close latch plate 235 engaged by the close D latch shaft 239, the close prop 223 is rotated to the stop or reset position shown in FIG. 10. When the close D latch shaft 239 is rotated to the release position, the close latch plate 235 falls through the notch 243 and the torsion spring 231 rotates the close prop 223 clockwise to the release position shown in FIG. 11 pulling the close latch plate 235 with it.

Figure 9:
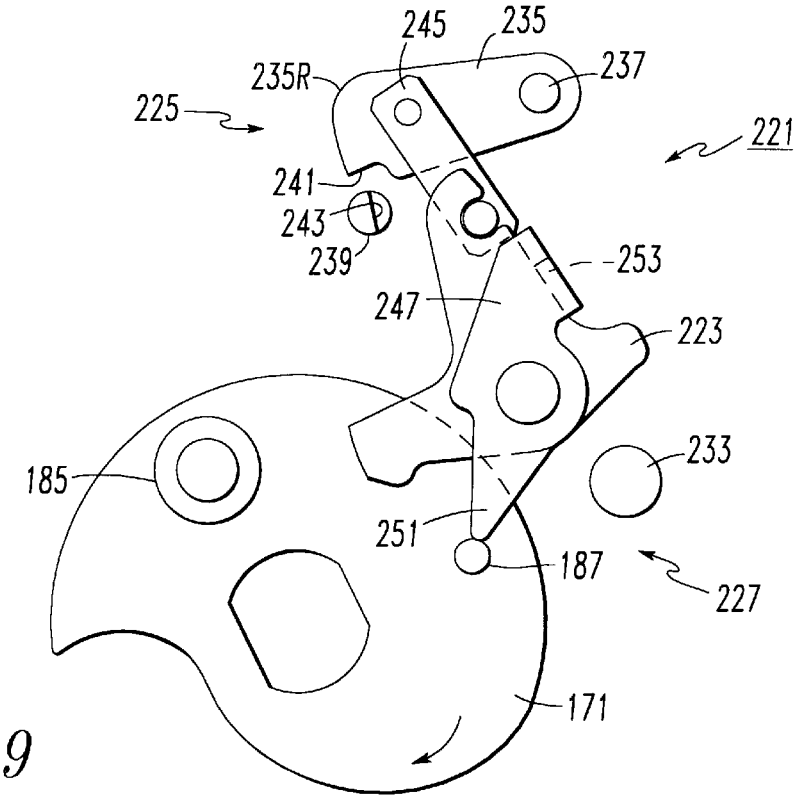
FIG. 9 is a view similar to FIG. 8 shown during charging of the close spring as the close prop is being reset.

The reset device 227 for the close prop mechanism 221 includes a reset lever 247 which is pivotally mounted on the same shaft 229 as the close prop 223 but is rotatable independently of the close prop. The reset device 227 also includes a reset member in the form of the reset pin 187 provided between the close cam plate 173*a* and drive cam plate 175*a* in advance of the stop roller 185 in the direction of rotation. With the close prop mechanism 221 unlatched as shown in FIG. 8, the close prop 223 is biased against the stop 233 by the torsion spring 231. As the cam member 171 rotates to charge the spring, the reset pin 187 engages a finger 251 on the reset lever 247. As shown in FIG. 9, clockwise rotation of the cam member 171 causes counter-clockwise rotation of the reset lever. The reset lever 247 has a flange 253 which engages the close prop 223 so that the close prop rotates with the reset lever. Alternatively, of course, the close prop 223 could have a flange engaged by the reset lever 247. The link 245 pushes the close latch plate 235 toward the close D latch shaft 239 and the rounded corner 235R on the close latch plate 235 rotates the close D latch shaft 239 to allow the latch shaft to pass through the notch 243. When the close latch plate 235 passes above the close D latch shaft 239, the latter rotates back so that as the reset lever 247 slides off of the reset pin 187 and the torsion spring 231 biases the close prop 223 clockwise, the latch ledge 241 engages the close D latch shaft 239 to maintain the close prop 223 in the reset or latched position shown in FIG. 10. As mentioned, the reset lever 247 can rotate independently of the close prop 223, but it is biased against the close prop by a second torsion spring 255 (see FIG. 12). However, since the manual charging system has a ratchet which allows the cam assembly 107 to backoff during recycling of the handle 31, the reset pin 187 can engage the reset lever 247 and rotate it clockwise against the bias force of the second torsion spring 255 and away from the latched close prop 223. This prevents damage to the close prop mechanism 221.

As previously discussed, the close spring 18 can be charged manually or electrically through rotation of the cam shaft 115. The drive mechanism 387 for manually or electrically rotating the cam shaft 115 is shown in FIGS. 13–17. This drive mechanism 387 includes a pair of ratchet wheels 389*a* and 399*b* keyed to flats on the cam shaft 115. Also keyed to the cam shaft between the ratchet wheels 389 are a handle decoupling cam 391 and a motor decoupling cam 393. Pins 395 couple the cams 391 and 393 to the ratchet wheels 389 so that torque is transmitted from the ratchet wheels into the cam shaft 115 through the cams 391 and 393 as well as through the ratchet wheels directly.

The ratchet wheels 389 are rotated by the charge handle 31 through a handle drive link 397 made up of two links 397*a* and 397*b* with the link 397*b* only having a cam surface 399 near the free end. This free end of the handle drive link 397 extends between the pair of ratchet wheels 389 and has a handle drive pin 401 which can engage peripheral ratchet teeth 403 in the ratchet wheels. The other end of the handle drive link 397 is pivotally connected to the handle 31 by a pivot pin 405.

The handle 31 is pivotally mounted on an extension of the rocker pin 127 and is retained by a C-clamp 407. A stop dog 409 made up of a pair of plates 409*a* and 409*b* is also pivoted on the rocker pin 127. This stop dog 409 also extends between the ratchet plates 389*a* and 389*b* and has a transverse stop pin 411 which engages the ratchet teeth 403. A tension spring 413 (see FIG. 16) biases the handle drive link 397 and the stop dog 409 toward each other and toward engagement with the ratchet wheels 389. In addition, a torsion spring 415 is mounted on the rocker pin 127 and has one leg 415*a* which bears against the underside of the handle and biases it toward a stowed position such as shown in FIG. 13 and a second arm 415*b* which bears against the underside of the stop dog and also biases it toward the ratchet wheels 389.

Figure 15:
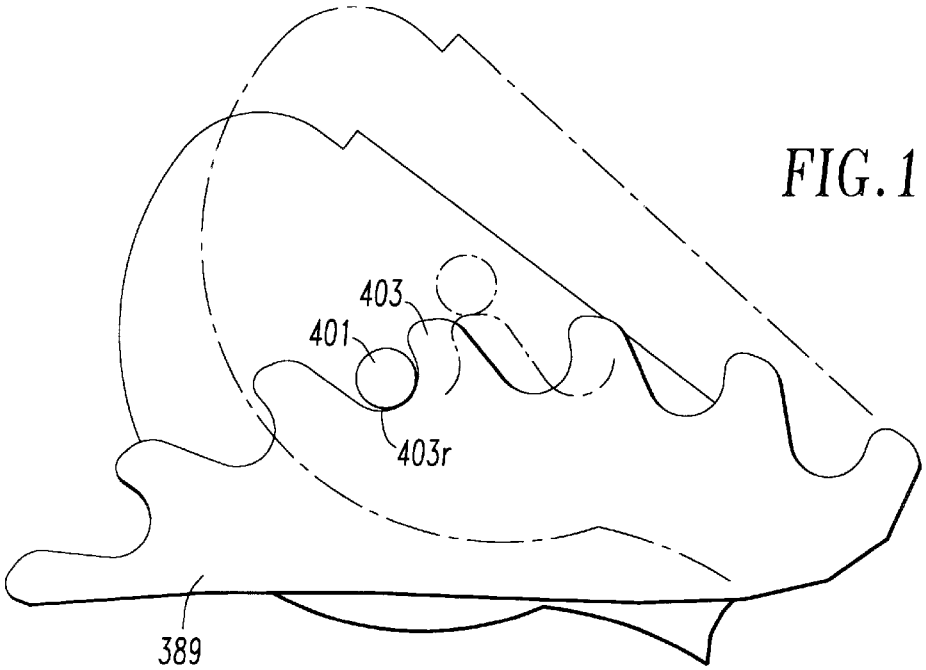
FIG. 15 is an elevation view of an enlarged scale of a section of a ratchet wheel which forms part of the spring charging mechanism.

As shown in the fragmentary view of FIG. 15, the ratchet teeth 403 are of an arcuate configuration and have roots 403*r* having a radius which is complementary to the radii of the handle drive pin 401 and the stop pin 411. This configuration reduces stress concentration at the roots of the ratchet teeth 403 and also makes it easier to manufacture the ratchet wheels 389 in that they can be easily stamped from flat stock material. The use of turned pins for the handle drive pin 401 and the stop pin 411 also eliminate the stress concentrations created by having the usual straight edged drive and stop teeth.

Figure 13:
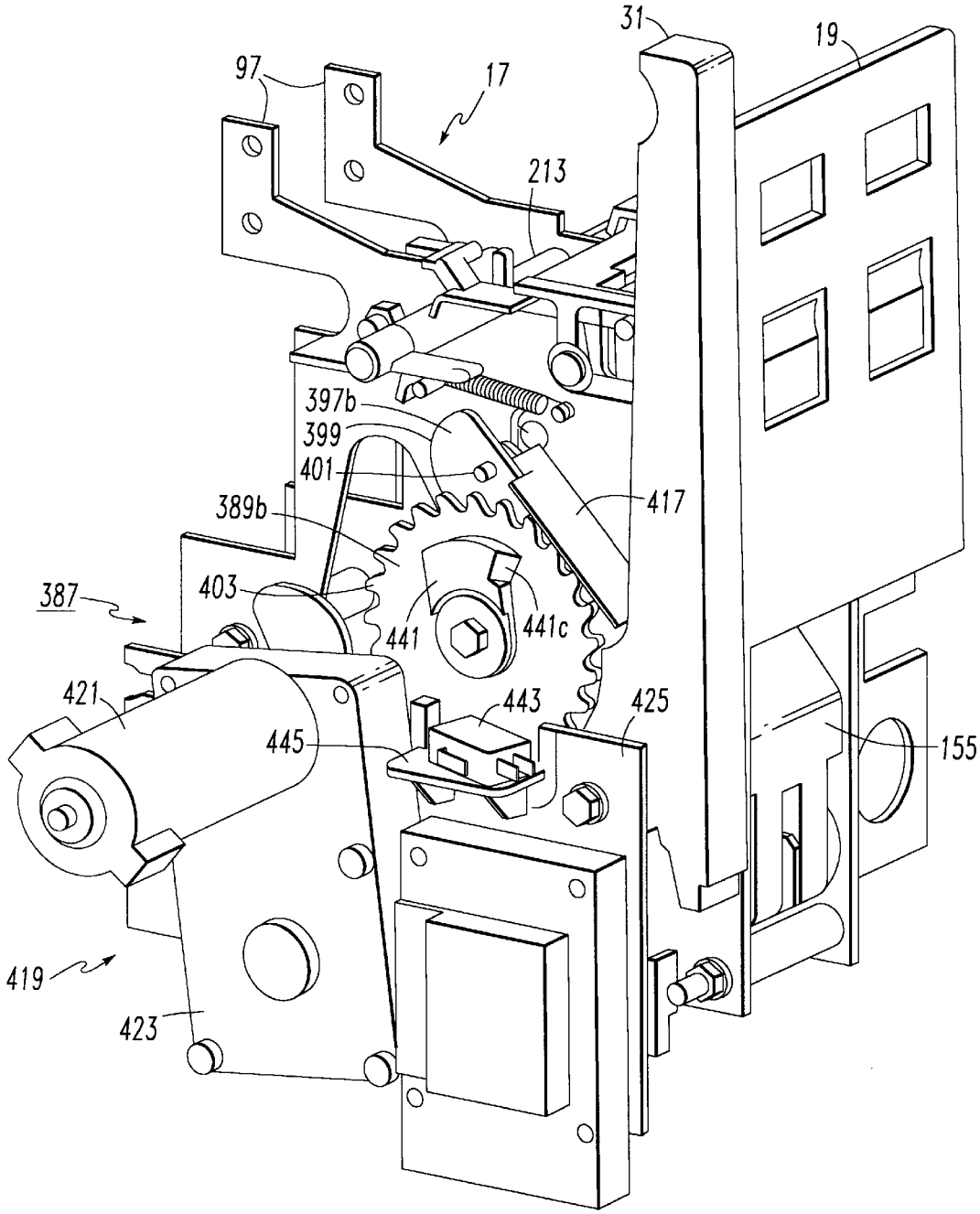
FIG. 13 is an isometric view of the assembled operating mechanism particularly illustrating the manual and electric charging system.
Figure 14:
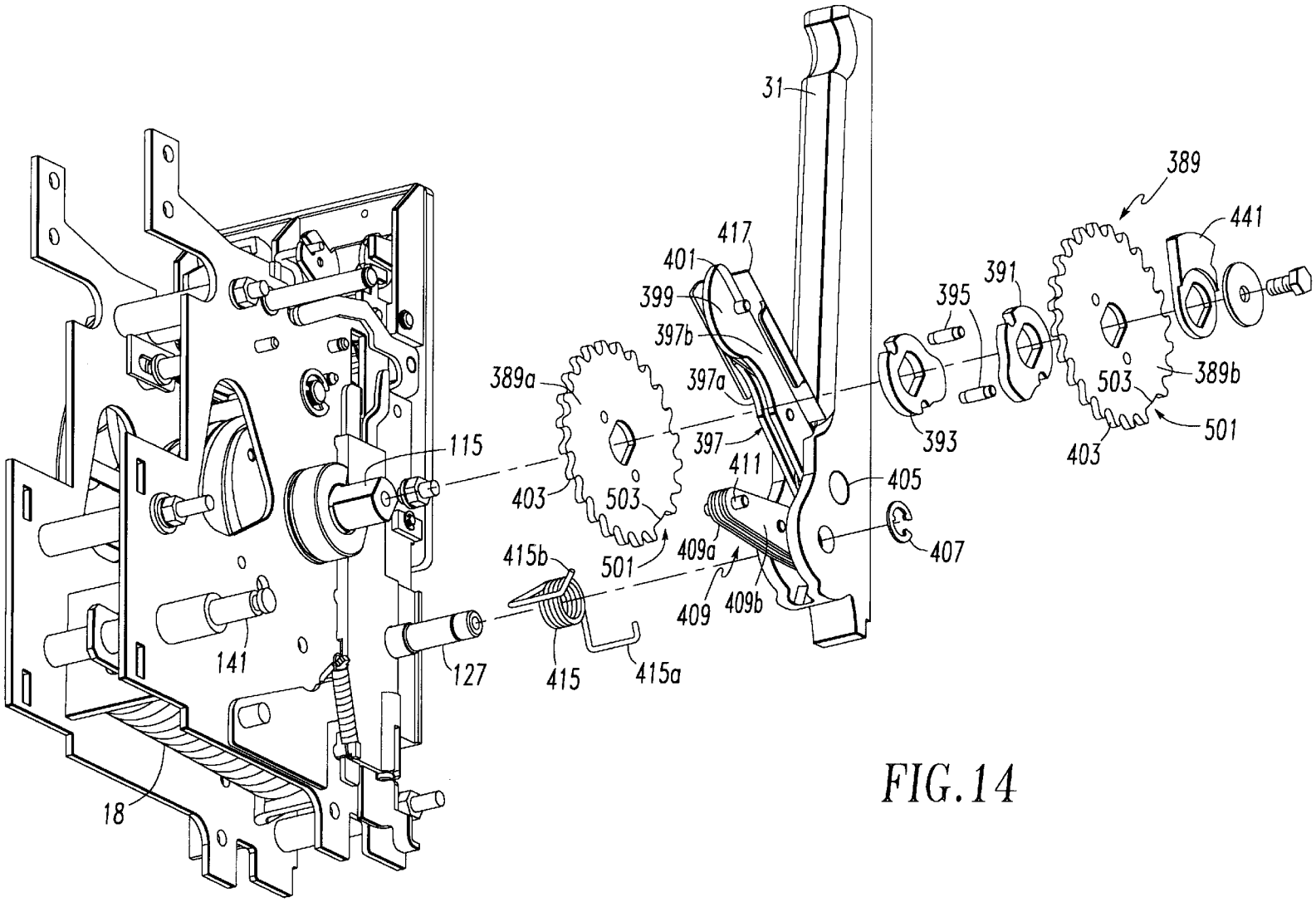
FIG. 14 is an exploded isometric view of the manual charging mechanism for the close spring.
Figure 16:
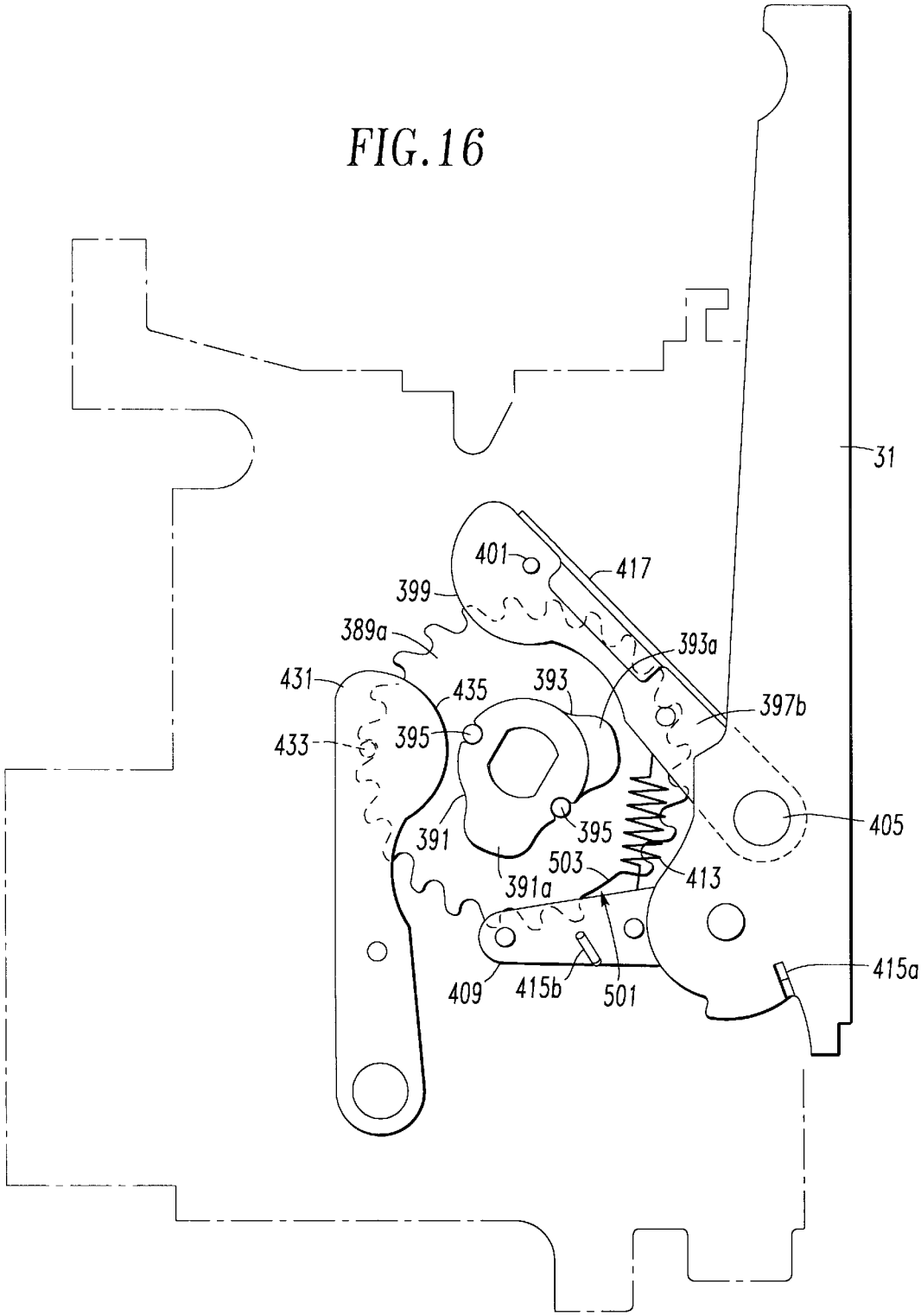
FIG. 16 is a side elevation view of the operating mechanism showing the close spring charging mechanism assembled and with a portion of the motor charging unit removed for clarity.

The close spring 18 is manually charged by pulling the handle 31 downward in a clockwise direction as viewed in FIGS. 13, 14 and 16. As the handle is pulled downward, the handle drive pin 401 engages a tooth 403 in each of the ratchet wheels 389*a* and 389*b* to rotate the cam shaft 115 clockwise. The springs 413 and 415 allow the stop dog to pass over the clockwise rotating ratchet teeth 403. At the end of the handle stroke, the torsion spring 415 returns the handle 31 toward the stowed position. Again, the spring 413 allows the handle drive pin to pass over the teeth which are held stationary by the stop dog 409. As the handle 31 is mounted on the rocker pin 127 instead of the cam shaft 115 so that it rotates about an axis which is parallel to but laterally spaced from the axis of the ratchet wheels, the drive link 397 can be connected by the pin 405 to the handle 31 at a point which is closer to the axis provided by the rocker pin 127 than the radii of the ratchet wheels 389*a* and 389*b*. This arrangement provides a greater mechanical advantage for the handle 31 which of course is significantly longer than the radii of the ratchet wheels 389*a* and 389*b*.

Figure 10:
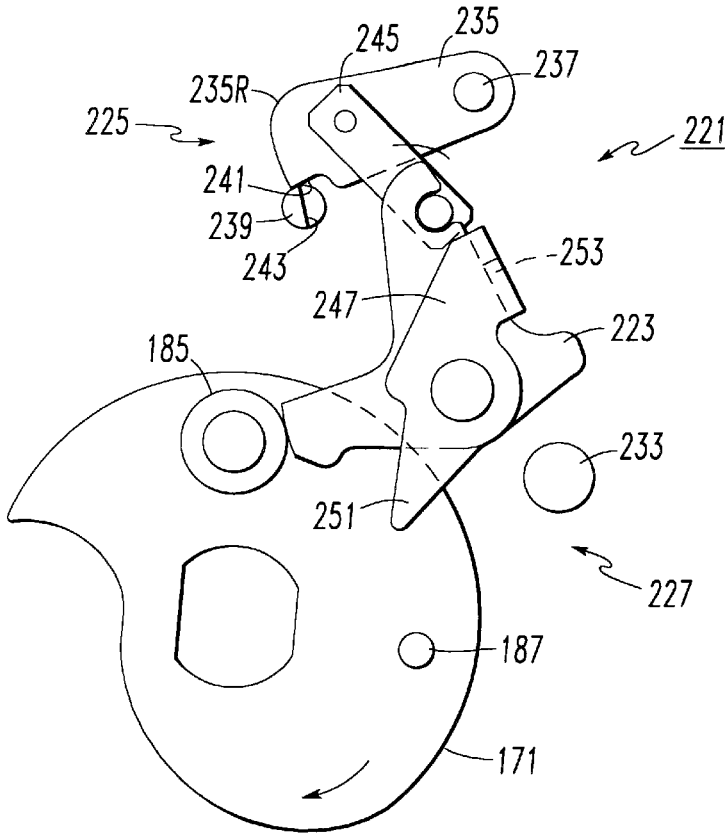
FIG. 10 is a view similar to FIG. 8 showing the close prop holding the spring in the charged state.
Figure 11:
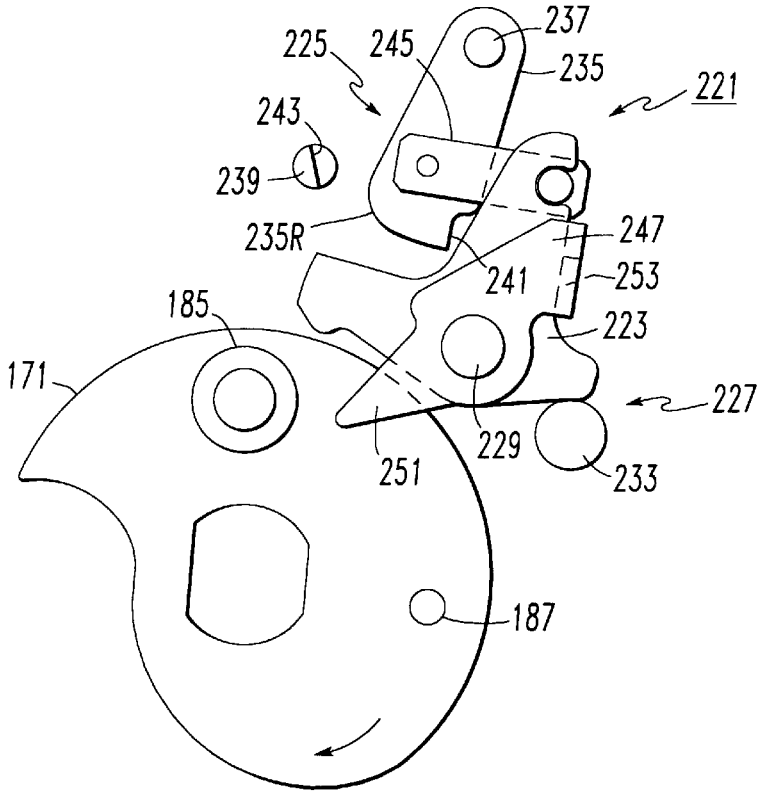
FIG. 11 is a view similar to FIG. 8 illustrating the close prop immediately after it has been released to close the contacts.

The handle 31 is repetitively reciprocated to incrementally rotate the ratchet wheels 389 and therefore the cam shaft 115 to charge the spring 18. As the spring 18 becomes fully charged, the handle decoupling cam 391 rotates to a position where the cam lobe 391*a* engages the cam surface 399 on the handle drive link plate 397*b* and lifts the drive link 397 upward so that the handle drive pin 401 is disengaged from the ratchet teeth 403 of the ratchet wheels 389. Thus, once the close spring 18 has been charged and the close prop 223 is sitting against the cam member 171 (as shown in FIG. 10), the handle 31 is disconnected so that force can no longer be applied to attempt to rotate the cam shaft 115 against the close prop 223.

When the close spring 18 is released, the cam shaft 115 rotates rapidly. It has been found that as this occurs the bouncing of the handle drive pin 401 by the rapidly turning ratchet teeth 403 causes the handle 31 to pop out of the stowed position. This is prevented by an arrangement through which the drive pin 401 is disengaged from the ratchet teeth 403 with the handle in the stowed position. In one embodiment, a lateral projection in the form of a cover plate 417 on the tops of the handle drive link 397 performs this function. This cover plate 417 rides on the tops of the ratchet teeth 403 with the handle in the stowed position thereby lifting the handle drive pin 401 clear of the ratchet teeth 403 as illustrated in FIG. 13. This does not interfere with the normal operation of the handle 31, because as the handle is pulled downward the cover plate 417 slides along the teeth until the handle drive pin 401 drops down into engagement with a tooth 463 on each of the ratchet wheels 389. Preferably, the cover plate 417 is molded of a resilient resin material.

Figure 17:
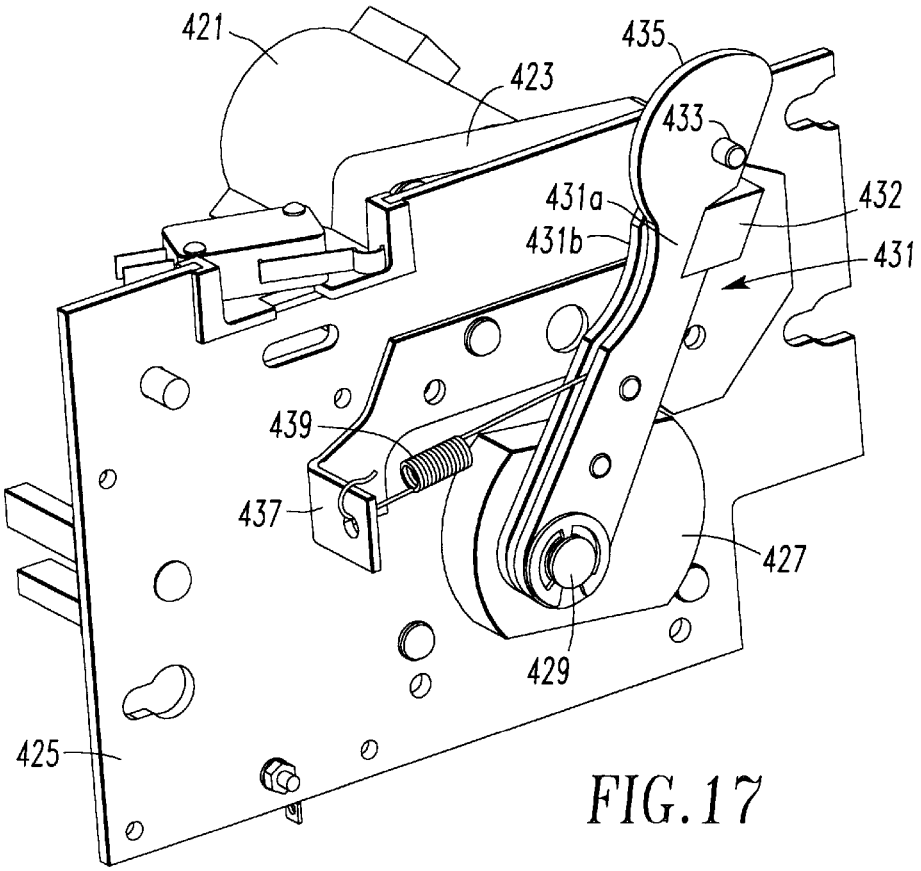
FIG. 17 is an isometric view of the motor operator for electrically charging the close spring.

The drive mechanism 387 may also include a motor operator 419 which includes a small high torque electric motor 421 with a gear reduction box 423. A mounting plate 425 attaches the optional motor operator 419 to the side of the operating mechanism 17 at support points which include the spring support pin 141. As can be seen in FIGS. 16 and 17, the output shaft (not shown) of the gear box has an eccentric 427 to which is mounted by the pivot pin 429 a motor drive link 431. The drive link 431 is fabricated from two plates 431*a* and 431*b* which support adjacent a free end a transverse, turned motor drive pin 433. The motor drive link 431*a* has a cam surface 435 adjacent the motor drive pin 433. A bracket 437 supports a tension spring 439 which biases the motor drive link 431 counterclockwise as viewed in FIG. 37. A V-shaped plastic stop 432 supported by a flange on the bracket 437 centers the motor drive link 431 for proper alignment for engaging the ratchet wheel 389. As can be appreciated from FIG. 16, with the motor operator 419 mounted on the side of the operating mechanism 17, the spring 439 biases the motor drive pin 433 into engagement with the ratchet teeth 403 of the ratchet wheels 389. Operation of the motor 421 rotates the eccentric 427 which reciprocates the motor drive link 431 for repetitive incremental rotation of the ratchet wheels 389. When the close spring 18 becomes fully charged, the motor decoupling cam 393 rotates to a position (not shown) where the lobe 393*a* engages the cam surface 435 on the motor drive link 413*a* and lifts the motor drive link 431 away from the ratchet wheel 389 so that the motor drive pin 433 is disengaged from the ratchet teeth 403. Again, this prevents continued application of torque to the cam shaft which is being restrained from rotation by the close prop 223. At the same time, a motor shut off cam 441 (see FIG. 13) mounted on the end of the cam shaft 115 outside of the ratchet wheels 389 rotates to a position where it engages a motor cutoff microswitch 443 mounted on a platform 445 secured to the mounting plate 425. The axially extending cam surface 441*c* actuates the switch 443 to turn off the motor 421.

Figure 18:
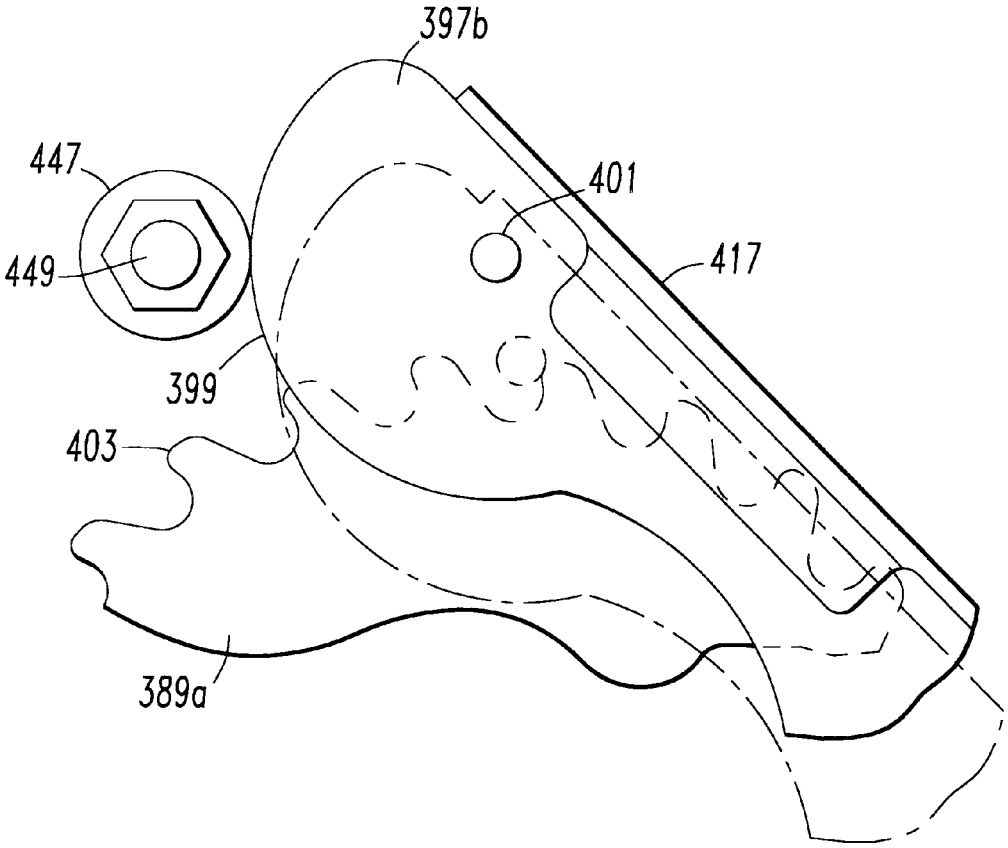
FIG. 18 is a fragmentary elevation view illustrating an alternative embodiment of the charging mechanism.
Figure 19:
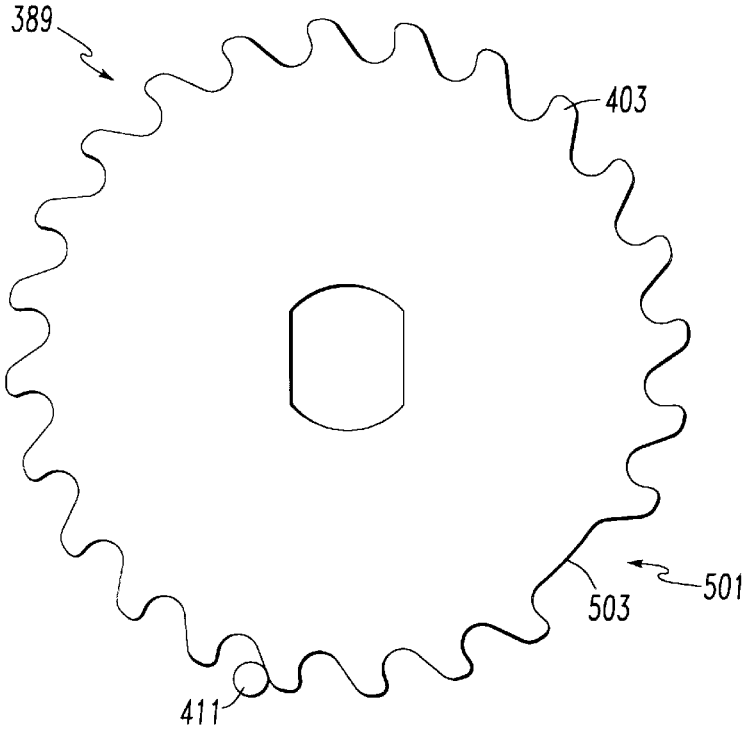
FIG. 19 is a side elevation view illustrating a ratchet wheel of the invention.
Figure 20:
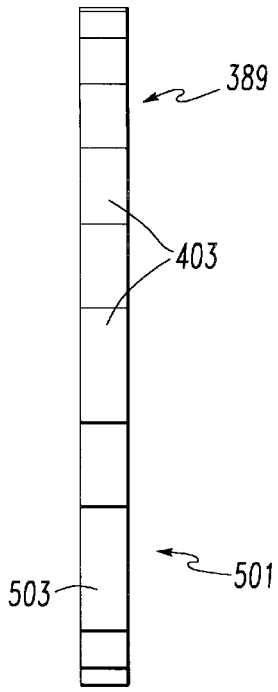
FIG. 20 is a front elevation view of the ratchet wheel shown in FIG. 19.
Figure 21:
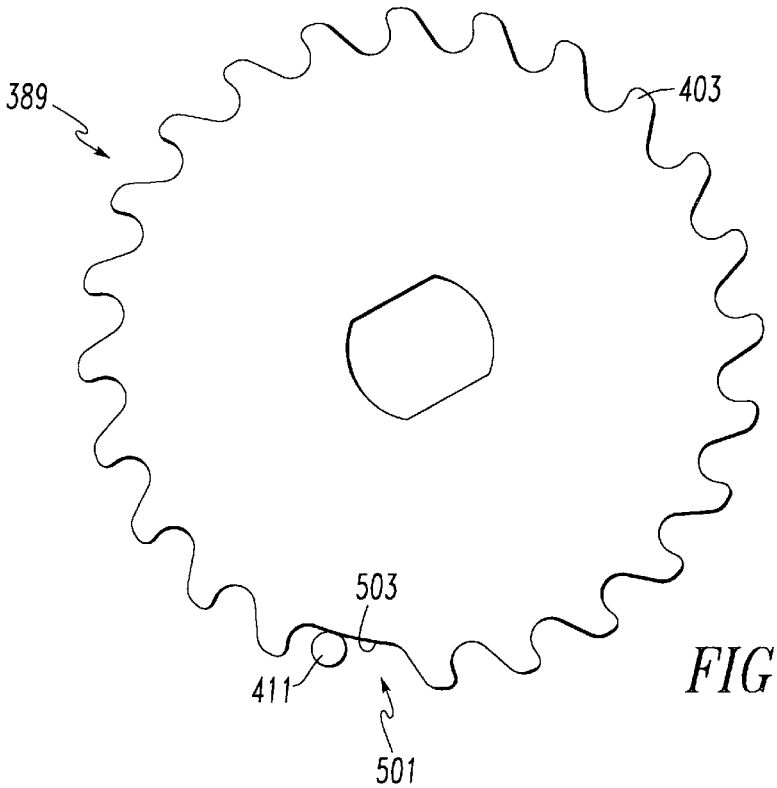
FIG. 21 is a view similar to FIG. 19 only showing the ratchet wheel in a different position.

An alternative arrangement for disengaging the handle drive pin 401 from the ratchet teeth 403 and the ratchet wheels 389 is illustrated in FIG. 18. In this embodiment, a lifting member or stop in the form of, for example, a sleeve 447 is fixed to the side plate 97 adjacent the ratchet wheel 389 by a bolt 449. As the handle 31 is returned to the stowed position, shown in full line in FIG. 18, the cam surface 399 on the drive link 397*b* engages the lift member 447 and rotates the drive link clockwise, as shown in the figure, to disengage the drive pin 401 from the ratchet teeth 403. Thus, when the close spring is released and the ratchet wheels rapidly rotate, the drive link is held clear of the ratchet wheel and the handle 31 is not disturbed. When the handle is pulled clockwise, it rotates about 15 degrees to the position shown in phantom in FIG. 18 in which the drive pin 401 reengages the ratchet teeth 403. Both this lifting member 447 and the cover plate 417 provide this about 15 degrees movement of the handle before a ratchet tooth is engaged. This allows the user to obtain a firm grip on the handle before the handle is loaded.

Referring to FIGS. 14 and 19–21, the ratchet wheels 389 and 389*a*, as described herein, include a plurality of teeth 403 extending from a periphery thereof. The ratchet wheels 389 and 389*a* are essentially identical and, therefore, reference to ratchet wheel 389 will be understood as generally referring to ratchet wheels 389 and 389*a* unless otherwise indicated. The ratchet wheel 389 also includes a toothless region, generally designated by reference number 501, also formed on the periphery thereof. As described, the torsion spring 415 biases the stop dog 409, and more specifically, biases the stop pin 411 of stop dog 409 into engagement with the teeth 403 of the ratchet wheel 389 to prevent reverse rotation of the ratchet wheel 389 when the close prop 223 is in the unlatched position during charging. The torsion spring 15 also biases the stop pin 411 of the stop dog 409 into engagement with the toothless region 501 of the ratchet wheel 389 when the close prop 223 is in the latch position, as will be described in more detail herein.

As also described, the ratchet teeth 403 have an arcuate profile including a root 403*r* with a radius complimentary to a radius of the stop pin 411. The toothless region 501 of the ratchet wheel 389 includes a bearing surface 503 for engagement with the stop pin 411 of the stop dog 409. The roots 403*r* of the ratchet teeth 403 and the bearing surface 503 of the toothless region 501 are preferably generally arcuately aligned on the periphery of the ratchet wheel 389. However, it will be appreciated that the bearing surface 503 may be formed on the ratchet wheel so as to extend inwardly from the periphery or extend outwardly from the periphery.

In addition, the toothless region 501, as shown, preferably includes the absence of one tooth on the periphery of the ratchet wheel 389. However, it will be appreciated that the absence of more than one tooth may be employed with the invention so long as the absence of more than one tooth is taken into consideration during the design and configuration of, for example, the drive link 397 and the charging handle 31. Preferably, actuation of the charging handle 31 and the drive link 397 results in the ratchet wheel 389 being rotated or advanced by at least two teeth per stroke of the drive link 397 and the charging handle 31. This ensures that for the embodiment where the toothless region 501 includes the absence of only one tooth that the drive link 397 will be able to rotate or advance the ratchet wheel 389 even if, for example, the drive pin 401 of the drive link 397 comes into engagement with the toothless region 501.

As described, rotation of the ratchet wheel 389 results in rotation of the charge cam 173 in order to charge the close spring 18. During the charging of the spring, the rocker rollers 165 are engaged by the charging portion 189*a* of the cam profile 189. Also during the charging of the close spring 18, the stop pin 411 of the stop dog 409 is biased into successive engagement with the ratchet teeth 403 to prevent reverse rotation of the ratchet wheels 389. This is necessary because during the charging of the close spring 18 the close prop 223 is in the unlatched position (see FIG. 8). Once the close spring 18 becomes fully charged (see FIG. 5) the charge cam 173 goes overcenter and a closing portion 189*b* of the cam profile 189 on the charge cam 173 comes into engagement with the rocker rollers 165 so that the energy stored in the close spring 18 will drive the cam member 171 clockwise when the mechanism is released. Also, when the close spring 18 is fully charged the close prop 223 engages the stop roller 185 on the cam member 171 to hold the close spring 18 in the charged condition (see FIG. 10).

As stated, when the close spring 18 is fully charged the rocker rollers 165 are in engagement with the closing portion 189*b* of the charge cam 173. More specifically, the rocker rollers 165 are in engagement with a transition portion 505 of the closing portion 189*b*. The transition portion 505 is positioned generally at the beginning of the closing portion 189*b* just as the charge cam goes overcenter and the diameter of the cam profile begins to decrease. The transition portion 505 has a profile that is decreasing in diameter slightly with a reduced slope (the remaining closing portion 189*b* has a steeper slope due to the diameter decreasing more rapidly) that helps to minimize the unlatching force of the close prop 223, which is desirable as will be described. When the rocker rollers 165 are in engagement with the transition portion 505 of the closing portion 189*b*, the compressed or charged close spring 18 exerts a large force through the rocker rollers 165 and applies the force to the charge cam 173. The resultant force being applied to the charge cam 173 includes a radial component, that accounts for the largest part of the force, and a tangential component, that attempts to drive the cam member 171 in a clockwise direction, as viewed in FIG. 5. The tangential component of the resultant force being applied through the rocker rollers 165 to the charge cam 173 is countered by the engagement between the close prop 223 and the stop roller 185 on the cam member 171. This ensures that the close spring 18 is held in the charged position.

It is desirable to minimize the force exerted by the stop roller 185 on the close prop 223 to minimize the unlatching force. However, when a larger close spring 18 with increased spring capacity is employed, for example, when larger electrical switching apparatus having more than the three poles illustrated herein are needed, the force that is applied on the charge cam 173 through the rocker rollers 165 increases. Of course, this results in a larger force as represented by the radial component and the tangential component that wants to drive the cam member 171 in the clockwise direction. To counter this increased force, there is a larger force exerted by the stop roller 185 on the close prop 223 which increases the rolling friction of the stop roller 185. This, of course, is contrary to the stated desirability of minimizing the force exerted by the stop roller 185 on the close prop 223 to minimize the unlatching torque. Thus, with the employment of a larger closing spring 18 and the resulting increased force being exerted by the stop roller 185 on the close prop 223, it becomes more difficult to initiate the closing operation where the energy stored in the close spring 18 will drive the cam member 171. It has been observed that due to use of a larger close spring 18 and the increased rolling friction plus the torque to lift the stop dog 409 and the stop pin 411 over the next ratchet tooth 403 is enough to keep the ratchet wheel 389 from rotating when the mechanism is released which, in turn, results in a stalled condition where the mechanism does not close the contacts 45 and 47. Of course, this is an undesirable condition.

To ensure that the close spring 18 begins discharging it is desirable to reduce the friction or the drag force within the mechanism. We have determined that this can be accomplished by providing the ratchet wheel 389 with the toothless region 501. As described, when the close spring 18 is fully charged it is held in the charged condition by the engagement between the stop roller 185 and the close prop 223. Accordingly, when the close spring 18 is fully charged it is no longer necessary for the stop pin 411 of the stop dog 409 to engage the teeth 403 of the ratchet wheel 389 to prevent reverse rotation of the ratchet wheel 389. Therefore, to reduce friction or drag force in the mechanism and to ensure that the close spring 18 begins discharging when desired, the ratchet wheel 389 is positioned on the cam shaft 115 such that when the close prop 223 is in the latch position and the close spring 18 is fully charged the stop pin 411 of the stop dog 409 is biased into engagement with the bearing surface 503 of the toothless region 501 (see FIG. 21). Then, once the close prop 223 is unlatched and the close spring 18 begins to drive the cam member 171, the stop pin 411 travels along the bearing surface 503 of the toothless region 501 as the ratchet wheel 389 is rotated in a clockwise direction. This arrangement eliminates the stop pin 411 having to travel up and over the next tooth on the ratchet wheel 389 as the close spring 18 begins to discharge. This reduces friction or drag force in the mechanism to help ensure that the close spring 18 discharge and that the contacts 45 and 47 close.

The elimination of a single tooth on the ratchet wheel 389 sufficiently reduces the friction or the drag force in the mechanism just as the discharging of the close spring 18 begins following the unlatching of the close prop 223. Once this process is initiated and momentum is built up in the mechanism, the rocker rollers 165 progressively engage the decreasing diameter closing portion 189*b* of the cam profile 189 to allow the close spring 18 to more efficiently drive the cam member 171. As the close spring 18 continues to drive the cam member 171 and the rocker rollers 165 are in engagement with the closing portion 189*b* of the cam profile 189, there is sufficient momentum built up in the mechanism to allow the stop pin 411 to effectively traverse the remaining teeth 403 on the ratchet wheel 389.

The friction or drag force is also reduced by the fact that the stop pin 411 of stop dog 409 is biased into engagement with bearing surface 503 by tension spring 415 which pulls stop dog 409 in toward ratchet wheel 389. This reduces the spring force of tension spring 415 when stop dog 409 engages toothless region 501 which in turn reduces friction or drag force in the mechanism. Friction or drag force is greater when the stop pin 411 engages the top of teeth 403 as the stop pin 411 traverses over the teeth 403.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. Electrical switching apparatus for an electric power distribution circuit comprising:

separable contacts for opening and closing said electric power distribution circuit;

an operating mechanism for operating said separable contacts comprising:

a close spring;

a cam shaft;

a first cam member mounted on said cam shaft, and coupling means for coupling said first cam member to said close spring for charging said close spring;

a second cam member mounted on said cam shaft, said second cam member coupled to and driven by said close spring as said close spring becomes fully charged;

a pivotally mounted close prop having a latch position in which it engages said second cam member and prevents rotation of said first cam member and said second cam member and an unlatched position in which it is disengaged from said second cam member so that said first cam member and said second cam member are free to be rotated by said close spring; and a charging mechanism comprising:

a ratchet wheel coupled to said cam shaft and having ratchet teeth extending from a periphery thereof, said ratchet wheel also having a toothless region on said periphery;

drive means for rotating said ratchet wheel; and a pivotally mounted stop dog and biasing means for biasing said stop dog into successive engagement with said ratchet teeth to prevent reverse rotation of said ratchet wheel when said close prop is in said unlatched position, said biasing means also biasing said stop dog into engagement with said toothless region of said ratchet wheel when said close prop is in said latch position.

2. The electrical switching apparatus of claim 1 wherein said stop dog includes a turned pin transversely mounted for engagement with said ratchet teeth and said toothless region of said ratchet wheel, and wherein said ratchet teeth have an arcuate profile including a root with a radius complementary to a radius of said turned pin.

3. The electrical switching apparatus of claim 2 wherein said toothless region includes a bearing surface for engagement with said turned pin of said stop dog, said root of said ratchet teeth and said bearing surface of said toothless region being generally arcuately aligned on said periphery of said ratchet wheel.

4. The electrical switching apparatus of claim 1 wherein said toothless region includes an absence of one tooth on said periphery of said ratchet wheel.

5. The electrical switching apparatus of claim 4 wherein said drive means includes a manual charge handle connected to a drive link that engages said ratchet teeth and rotates said ratchet wheel by at least two of the teeth per stroke of said drive link and said manual charge handle.

6. The electrical switching apparatus of claim 1 wherein said first cam member includes a cam profile for engagement with said coupling means, said cam profile having a charging portion and a closing portion, said closing portion having a transition portion, said stop dog in engagement with said toothless region to reduce friction between said ratchet wheel and said stop dog when said transition portion is in engagement with said coupling means to transition from said close spring being fully charged to discharging of said close spring.

7. Electrical switching apparatus for an electric power distribution circuit comprising:

contact means for opening and closing said electric power distribution circuit;

operating means for operating said contact means comprising:

a spring;

cam means coupled with said spring;

prop means for cooperating with said cam means, said prop means having a latch position to prevent rotation of said cam means and an unlatched position in which said cam means is free to be rotated by said spring; and charging means comprising:

ratchet means coupled to said cam means for rotating said cam means, said ratchet means including a ratchet wheel having ratchet teeth extending from a periphery thereof, said ratchet wheel also having a toothless region on said periphery;

drive means for rotating said ratchet wheel;

stop means for preventing reverse rotation of said ratchet wheel when said prop means is in said unlatched position; and biasing means for biasing said stop means into successive engagement with said ratchet teeth, said biasing means also biasing said stop means into engagement with said toothless region of said ratchet wheel when said prop means is in said latch position.

8. The electrical switching apparatus of claim 7 wherein said stop means includes a pivotally mounted stop dog having a turned pin transversely mounted for engagement with said ratchet teeth and said toothless region of said ratchet wheel, and wherein said ratchet teeth have an arcuate profile including a root with a radius complementary to a radius of said turned pin.

9. The electrical switching apparatus of claim 8 wherein said toothless region includes a bearing surface for engagement with said turned pin of said stop dog, said root of said ratchet teeth and said bearing surface of said toothless region being generally arcuately aligned on said periphery of said ratchet wheel.

10. The electrical switching apparatus of claim 7 wherein said toothless region includes an absence of one tooth on said periphery of said ratchet wheel.

11. The electrical switching apparatus of claim 10 wherein said drive means includes a manual charge handle connected to a drive link that engages said ratchet teeth and rotates said ratchet wheel by at least two of the teeth per stroke of said drive link and said manual charge handle.

12. The electrical switching apparatus of claim 7 wherein said cam means comprises a first cam member mounted on a cam shaft, and coupling means for coupling said first cam member to said spring for charging said spring;

said cam means also comprises a second cam member mounted on said cam shaft, said second cam member coupled to and driven by said spring as said spring becomes fully charged; and said first cam member includes a cam profile for engagement with said coupling means, said cam profile having a charging portion and a closing portion, said closing portion having a transition portion, said stop means including a pivotally mounted stop dog in engagement with said toothless region to reduce friction between said ratchet wheel and said stop dog when said transition portion is in engagement with said coupling means to transition from said spring being fully charged to discharging of said spring.

13. A charging mechanism for electrical switching apparatus having an operating mechanism, said charging mechanism comprising:

a ratchet wheel coupled to the operating mechanism and having ratchet teeth extending from a periphery thereof, said ratchet wheel also having a toothless region on said periphery;

a drive link pivotally mounted adjacent said ratchet wheel for engagement with and rotation of said ratchet wheel; and a pivotally mounted stop dog and biasing means for biasing said stop dog into successive engagement with said ratchet teeth to prevent reverse rotation of said ratchet wheel when a force is applied to said ratchet wheel by the operating mechanism, said biasing means also biasing said stop dog into engagement with said toothless region of said ratchet wheel when said force is removed from said ratchet wheel.

14. The charging mechanism of claim 13 wherein said stop dog includes a turned pin transversely mounted for engagement with said ratchet teeth and said toothless region of said ratchet wheel, and wherein said ratchet teeth have an arcuate profile including a root with a radius complementary to a radius of said turned pin.

15. The charging mechanism of claim 14 wherein said toothless region includes a bearing surface for engagement with said turned pin of said stop dog, said root of said ratchet teeth and said bearing surface of said toothless region being generally arcuately aligned on said periphery of said ratchet wheel.

16. The charging mechanism of claim 13 wherein said toothless region includes an absence of one tooth on said periphery of said ratchet wheel.

17. The charging mechanism of claim 13 wherein said biasing means includes a spring, the spring force of said spring being reduced when said stop dog is biased into engagement with said toothless region.

* * * * *